US010517384B2

(12) United States Patent
Davies-Smith et al.

(10) Patent No.: US 10,517,384 B2
(45) Date of Patent: Dec. 31, 2019

(54) PERSONAL CARE IMPLEMENT

(71) Applicant: Colgate-Palmolive Company, New York, NY (US)

(72) Inventors: Leighton Davies-Smith, Lebanon, NJ (US); Al Aquanza Sprosta, Maplewood, NJ (US); Shyamala Pillai, Hillsborough, NJ (US)

(73) Assignee: Colgate-Palmolive Company, New York, NY (US)

( * ) Notice: Subject to any disclaimer, the term of this patent is extended or adjusted under 35 U.S.C. 154(b) by 50 days.

(21) Appl. No.: 15/840,582

(22) Filed: Dec. 13, 2017

(65) Prior Publication Data

US 2018/0168327 A1 Jun. 21, 2018

Related U.S. Application Data

(60) Provisional application No. 62/436,758, filed on Dec. 20, 2016.

(51) Int. Cl.

| | |
|---|---|
| ***B43K 8/06*** | (2006.01) |
| ***A46B 11/00*** | (2006.01) |
| ***A46B 9/04*** | (2006.01) |

(52) U.S. Cl.

CPC ..... *A46B 11/0072* (2013.01); *A46B 9/04* (2013.01); *A46B 11/002* (2013.01); *A46B 11/0062* (2013.01); *A46B 11/0079* (2013.01); *A46B 2200/1066* (2013.01)

(58) Field of Classification Search

CPC ..... A46B 11/002; A46B 11/0062; A46B 11/0072; A46B 11/0079; A46B 2200/1066

USPC ..... 401/198, 270

See application file for complete search history.

(56) References Cited

U.S. PATENT DOCUMENTS

| | | | |
|---|---|---|---|
| 4,259,286 | A | 3/1981 | Louis et al. |
| 4,272,473 | A | 6/1981 | Riemersma et al. |
| 4,463,045 | A | 7/1984 | Ahr et al. |
| 4,859,519 | A | 9/1989 | Cage, Jr. et al. |

(Continued)

FOREIGN PATENT DOCUMENTS

| | | |
|---|---|---|
| WO | 2005/094719 | 10/2005 |
| WO | 2015/101897 | 7/2015 |
| WO | 2016/010607 | 1/2016 |

OTHER PUBLICATIONS

International Search Report and Written Opinion of the International Searching Authority in International Application No. PCT/US2017/066096, dated Aug. 30, 2018.

*Primary Examiner* — Jennifer C Chiang

(57) ABSTRACT

A personal care implement, such as an oral care implement, that includes a body containing a supply of a fluid. A flow barrier is positioned with a first surface adjacent to the supply of fluid and a second surface opposite the first surface. The flow barrier allows flow of the fluid through the flow barrier for application to a biological surface when the flow barrier is compressed and prevents or inhibits flow of another fluid that is in contact with the second surface of the flow barrier through the flow barrier in a static state. In certain embodiments, the fluid in the supply may have a first viscosity and a first surface tension and the another fluid may have a second viscosity and a second surface tension such that one of the first and second viscosities and one of the first and second surface tensions are different from each other.

22 Claims, 16 Drawing Sheets

(56) References Cited

U.S. PATENT DOCUMENTS

| | | | | |
|---|---|---|---|---|
| 5,207,962 | A | 5/1993 | Hovis et al. | |
| 5,814,389 | A | 9/1998 | Giacometti | |
| 5,915,868 | A | 6/1999 | Frazell | |
| 6,007,468 | A | 12/1999 | Giacometti | |
| 7,682,686 | B2 | 3/2010 | Curro et al. | |
| 8,075,216 | B2 | 12/2011 | Gatzemeyer et al. | |
| 8,158,043 | B2 | 4/2012 | Gibson et al. | |
| 8,506,196 | B2 | 8/2013 | Boyd et al. | |
| 8,517,728 | B2 | 8/2013 | Gatzemeyer et al. | |
| 8,591,132 | B2 | 11/2013 | Hui | |
| 9,700,130 | B2 * | 7/2017 | Kennedy | A46B 15/0061 |
| 9,848,693 | B2 * | 12/2017 | Jimenez | A46B 7/04 |
| 10,165,852 | B1 * | 1/2019 | Christman | A46B 11/0041 |
| 2018/0078027 | A1 | 3/2018 | Jimenez et al. | |

* cited by examiner

PERSONAL CARE IMPLEMENT

CROSS-REFERENCE TO RELATED APPLICATIONS

The present application claims the benefit of U.S. Provisional Application Ser. No. 62/436,758, filed Dec. 20, 2016, the entirety of which is incorporated herein by reference.

BACKGROUND

Oral care implements, particularly toothbrushes, are typically used by applying toothpaste to a bristle section followed by brushing regions of the oral cavity with the bristle section. Some toothbrushes have been equipped with fluid reservoirs and systems for delivering auxiliary active agents, such as whitening agents, breath freshening agents, and the like to the bristle section. However, such toothbrushes suffer from deficiencies including clogging of the delivery mechanism that prevents proper dispensing, unwanted leakage during non-use of the toothbrush, and improper volumes of fluid dispensed during brushing. There is a continuing need for alternative oral care implements for delivering auxiliary active agents that effectively deliver the auxiliary active agent during use of the oral care implement while overcoming the above-noted deficiencies.

BRIEF SUMMARY

The present invention is directed to a personal care implement, such as an oral care implement, that includes a body containing a supply of a fluid. A flow barrier is positioned with a first surface adjacent to the supply of fluid and a second surface opposite the first surface. The flow barrier allows flow of the fluid through the flow barrier for application to a biological surface when the flow barrier is compressed and prevents or inhibits flow of another fluid that is in contact with the second surface of the flow barrier through the flow barrier in a static state. In certain embodiments, the fluid in the supply may have a first viscosity and a first surface tension and the another fluid may have a second viscosity and a second surface tension such that one of the first and second viscosities and/or one of the first and second surface tensions are different from each other.

In one aspect, the invention may be a personal care implement comprising: a body containing a supply of a first fluid; a flow barrier having a first surface adjacent the supply and a second surface opposite the first surface, the flow barrier configured to: (1) allow flow of the first fluid from the supply through the flow barrier for application to a biological surface in a compressed state; and (2) prohibit flow of a second fluid that is in contact with the second surface of the flow barrier through the flow barrier in a static state under ambient conditions; and wherein, at ambient conditions, the first fluid has a first viscosity and a first surface tension and the second fluid has a second viscosity and a second surface tension, at least one of the first viscosity being different than the second viscosity or the first surface tension being different than the second surface tension.

In another aspect, the invention may be a personal care implement comprising: a body containing a supply of a first fluid; and a first apertured film adjacent the supply of the first fluid for dispensing the first fluid to a biological surface, the first apertured film comprising: a first surface; a second surface opposite the first surface; and a plurality of first apertures, each of the first apertures extending from a first opening in the first surface of the first apertured film to a second opening in the second surface of the first apertured film, and wherein the first opening has a transverse area that is greater than a transverse area of the second opening.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
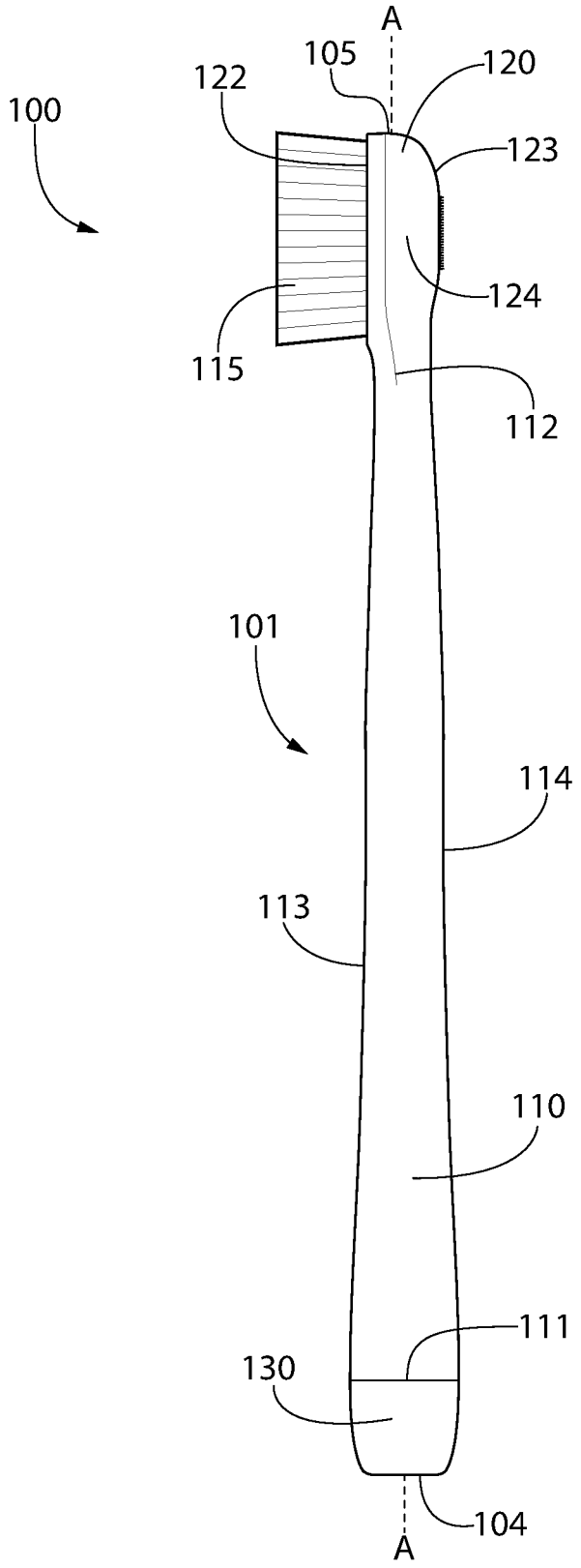
FIG. 1 is side view of a personal care implement in accordance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Referring first to FIG. 1, a personal care implement 100 is illustrated in accordance with an embodiment of the present invention. In the exemplified embodiment, the personal care implement 100 is an oral care implement, and more specifically a manual toothbrush. Thus, the invention will be described herein with the details predominately directed to a toothbrush. However, in certain other embodiments the personal care implement 100 can take on other forms such as being a powered toothbrush, a tongue scraper, a gum and soft tissue cleanser, a water pick, an interdental device, a tooth polisher, a specially designed ansate implement having tooth engaging elements, or any other type of implement that is commonly used for oral care. Still further, the personal care implement 100 may not be one that is specifically used for oral care in all embodiments, but rather it may be an implement such as a deodorant application implement, a face or body cleaning implement, a make-up applicator implement, a razor or shaving implement, a hairbrush, or the like. Thus, it is to be understood that the inventive concepts discussed herein can be applied to any type of personal care implement unless a specific type of personal care implement is specified in the claims.

The personal care implement 100 generally includes a body 101 comprising a handle 110 and a head 120 and an end cap 130 that is detachably coupled to the handle 110. The body 101 generally extends along a longitudinal axis A-A from a proximal end 104 to a distal end 105. Conceptually, the longitudinal axis A-A is a reference line that is generally coextensive with the three-dimensional center line of the body 101. Because the body 101 may, in certain embodiments, be a non-linear structure, the longitudinal axis A-A of the body 101 may also be non-linear in certain embodiments. However, the invention is not to be so limited in all embodiments and in certain other embodiments the body 101 may have a simple linear arrangement and thus a substantially linear longitudinal axis A-A.

The handle 110 extends from a proximal end 111 to a distal end 112 and the head 120 is coupled to the distal end 112 of the handle 110. In the exemplified embodiment, the end cap 130 is detachably coupled to the proximal end 111 of the handle 120. The end cap 130 may be detachable from the handle 120 so that an oral care material can be stored within the body 101 (discussed in more detail below with reference to FIG. 7) and can be refilled by detaching the end cap 130 from the handle 110 to provide access to a cavity/reservoir within the body 101 within which the oral care material may be stored. Furthermore, in certain embodiments the end cap 130 may be altogether omitted and the proximal end 111 of the body 104 may form a closed bottom end of the personal care implement 100. In such embodiments, refill of the reservoir may not be possible or may occur through other mechanisms/structures as would be understood to persons skilled in the art.

The handle 110 is an elongated structure that provides the mechanism by which the user can hold and manipulate the personal care implement 100 during use. The handle 110 comprises a front surface 113 and an opposing rear surface 114. In the exemplified embodiment, the handle 110 is generically depicted having various contours for user comfort. Of course, the invention is not to be so limited in all embodiments and in certain other embodiments the handle 110 can take on a wide variety of shapes, contours and configurations, none of which are limiting of the present invention unless so specified in the claims.

In the exemplified embodiment, the handle 110 is formed of a rigid plastic material, such as, for example without limitation, polymers and copolymers of ethylene, propylene, butadiene, vinyl compounds, and polyesters such as polyethylene terephthalate. Of course, the invention is not to be so limited in all embodiments and the handle 110 may include a resilient material, such as a thermoplastic elastomer, as a grip cover that is molded over portions of or the entirety of the handle 110 to enhance the gripability of the handle 110 during use. For example, portions of the handle 110 that are typically gripped by a user's palm during use may be overmolded with a thermoplastic elastomer or other resilient material to further increase comfort to a user.

The head 120 of the personal care implement 100 is coupled to the handle 110 and comprises a front surface 122, an opposing rear surface 123, and a peripheral surface 124 extending between the front and rear surfaces 122, 123. In the exemplified embodiment, the head 120 is formed integrally with the handle 110 as a single unitary structure using a molding, milling, machining or other suitable process. However, in other embodiments the handle 110 and the head 120 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. In some embodiments the head 120 may be detachable from the handle 110. The head 120 may be formed of any one of the materials discussed above with regard to the handle 110.

In the exemplified embodiment, the head 120 of the personal care implement 100 is provided with a plurality of tooth cleaning elements 115 extending from the front surface 122. Furthermore, in the exemplified embodiment the tooth cleaning elements 115 are generically illustrated. In certain embodiments the exact structure, pattern, orientation and material of the tooth cleaning elements 115 are not to be limiting of the present invention. Thus, as used herein, the term "tooth cleaning elements" is used in a generic sense to refer to any structure that can be used to clean, polish or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, spiral bristles, rubber bristles, elastomeric protrusions, flexible polymer protrusions, combinations thereof, and/or structures containing such materials or combinations. Suitable elastomeric materials include any biocompatible resilient material suitable for uses in an oral hygiene apparatus. To provide optimum comfort as well as cleaning benefits, the elastomeric material of the tooth or soft tissue engaging elements has a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

Figure 2:
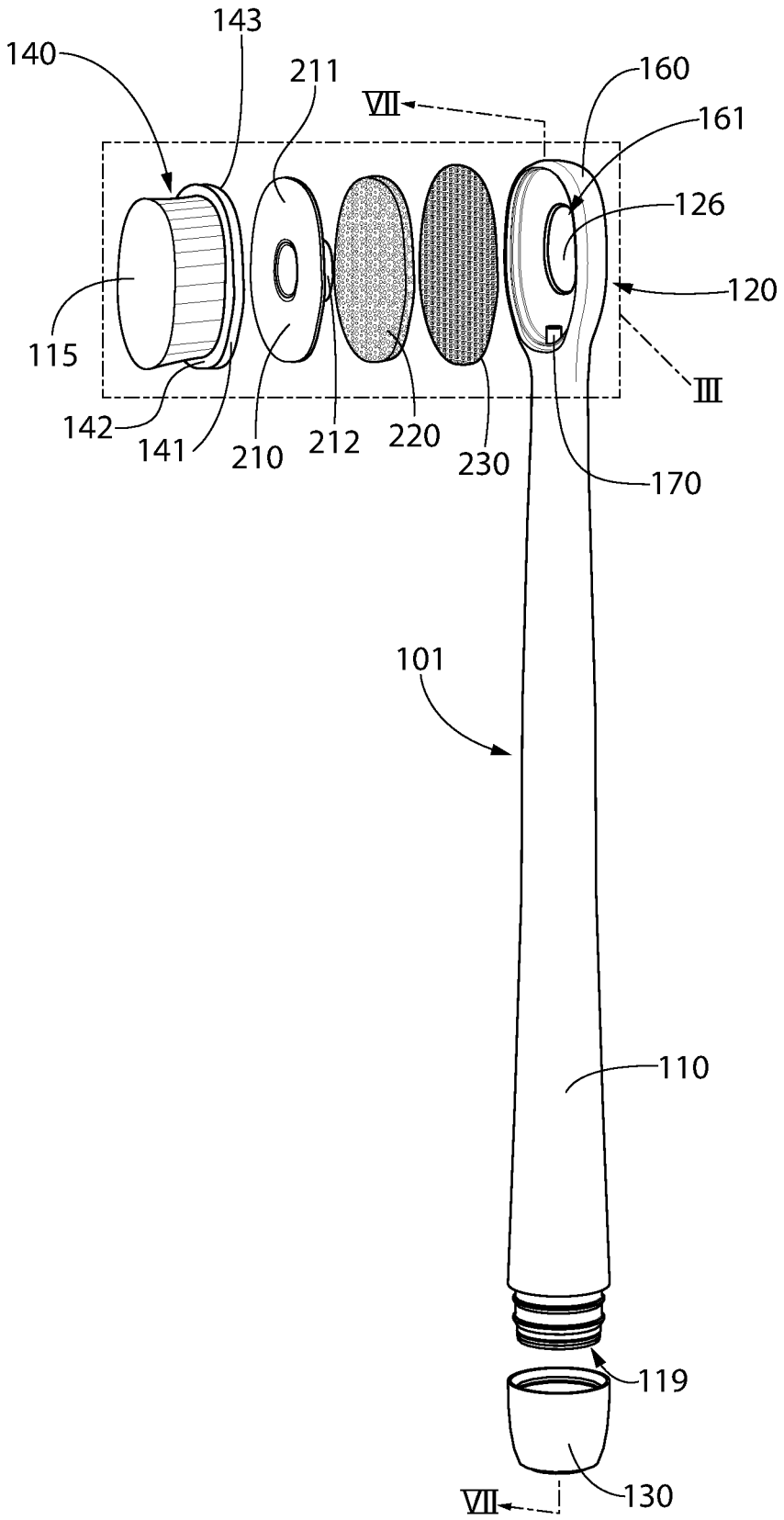
FIG. 2 is an exploded perspective view of the personal care implement of FIG. 1.
Figure 3:
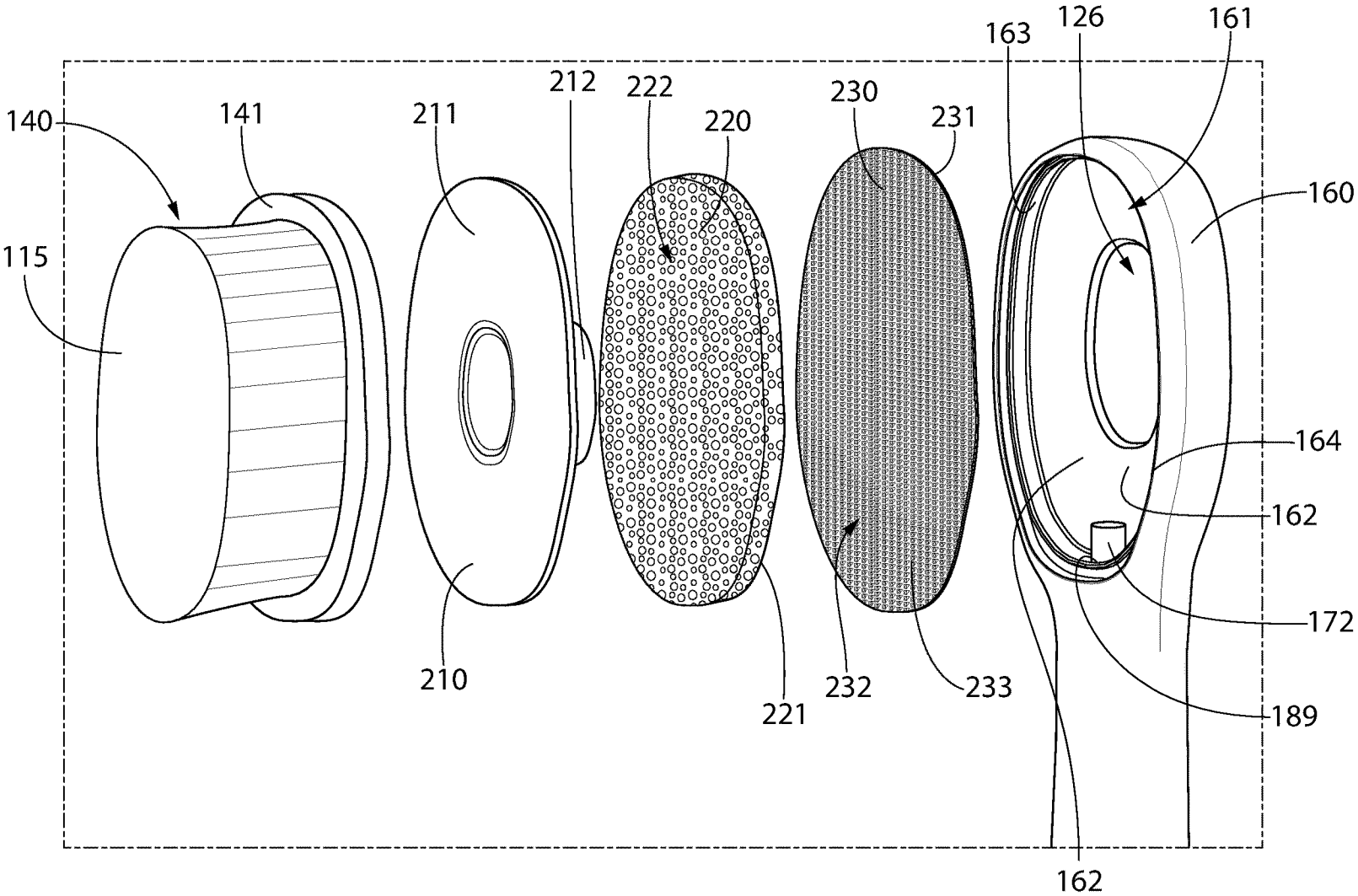
FIG. 3 is a close-up view of area III of FIG. 2
Figure 8:
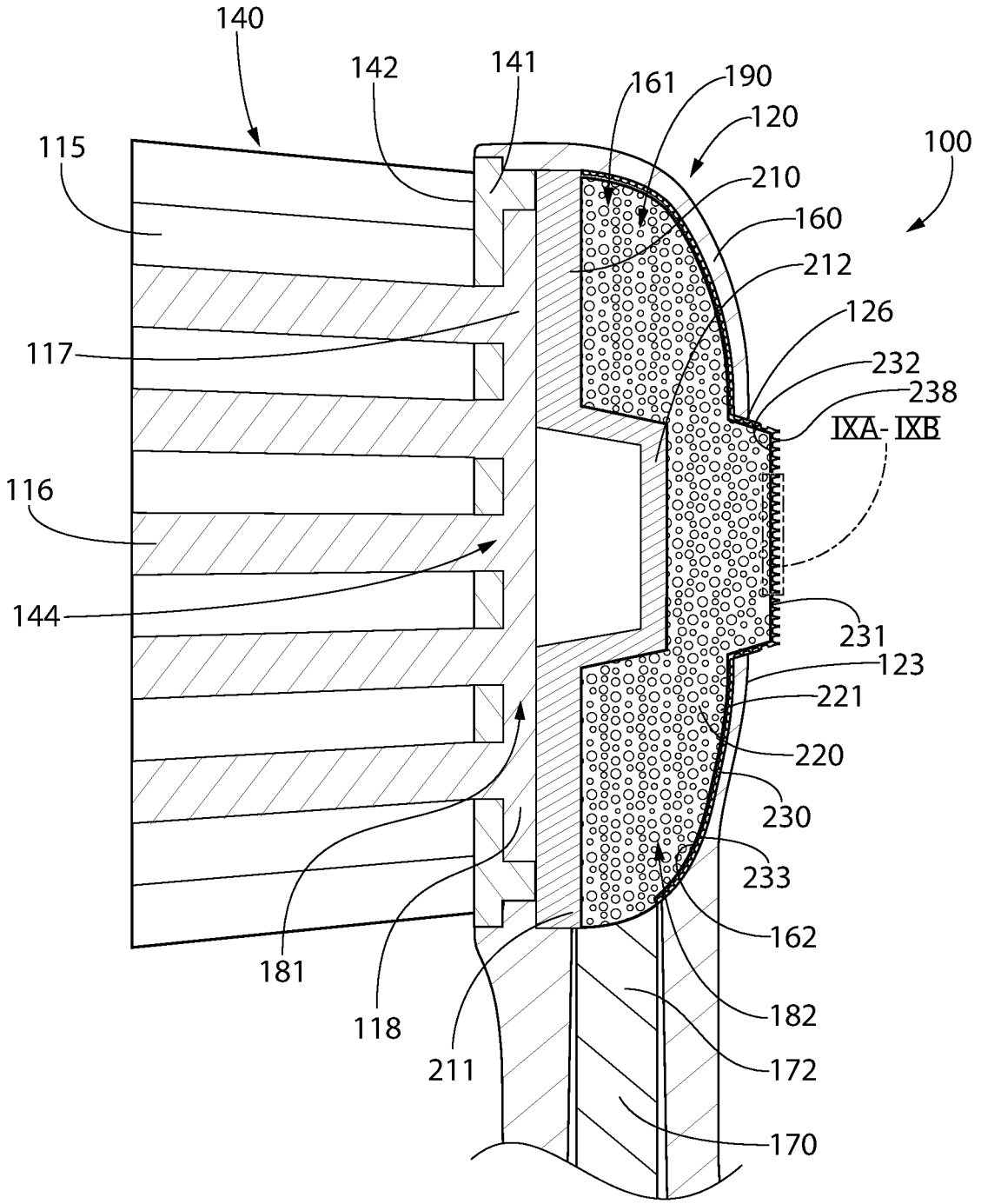
FIG. 8 is a close-up view of area VIII of FIG. 7.

Referring to FIGS. 2, 3, and 8, in the exemplified embodiment the tooth cleaning elements 115 are formed on a cleaning element assembly 140 that comprises a head plate 141 and the tooth cleaning elements 115 mounted thereon. In such an embodiment, the head plate 141 is a separate and distinct component from the body 101 of the personal care implement 100. However, the head plate 141 is connected to the body 101 at a later stage of the manufacturing process by any suitable technique known in the art, including without limitation thermal or ultrasonic welding, any fusion techniques such as thermal fusion, melting, a tight-fit assembly, a coupling sleeve, threaded engagement, adhesion, or fasteners. Thus, the head plate 141 and the body 101 are separately formed components that are secured together during manufacture of the personal care implement 100. More specifically, the tooth cleaning elements 115 are secured to the head plate 141 in the manner discussed herein below to form the cleaning element assembly 140, and then the cleaning element assembly 140 is coupled to a base portion 160 of the head 120.

In certain embodiments, the head plate 141 comprises an upper surface 142 and an opposing lower surface 143. Furthermore, the head plate 141 comprises a plurality of tuft holes 144 extending through the head plate 141 from the upper surface 142 to the lower surface 143. The tooth cleaning elements 115 are grouped together into bristle tufts, each of which is positioned within one of the tuft holes 144 of the head plate 141. Specifically, the bristle tufts are positioned within the tuft holes 144 such that a first portion 116 of each of the bristle tufts extends from the upper surface 142 of the head plate 141 and a second portion 117 of each of the bristle tufts protrudes from the lower surface 143 of the head plate 141. Of course, elastomeric tooth cleaning elements may be positioned in one or more of the tuft holes 144 in place of bristle tufts in some embodiments.

The first portions 116 of the tooth cleaning elements 115 extending from the upper surface 142 of the head plate 141 perform the tooth cleaning function and the second portions 117 of the tooth cleaning elements 115 extending from the lower surface 143 of the head plate 141 are melted together by heat to be anchored in place. Specifically, melting the second portions 117 of the tooth cleaning elements 115 creates a melt matte 118 on the lower surface 143 of the head plate 141. The melt matte 118 is a layer of plastic formed from the collective second portions 117 of the tooth cleaning elements 115 that prevents the tooth cleaning elements 115 from being pulled through the tuft holes 141. More specifically, the melt matte 118 is a thin layer of plastic that is formed by melting the second portions 117 of the tooth cleaning elements 115 so that the second portions 117 of the tooth cleaning elements 115 transition into a liquid, at which point the liquid of the second portions 117 of the tooth cleaning elements 115 combine together into a layer of liquid plastic that at least partially covers the lower surface 143 of the head plate 141. This layer of liquid plastic then hardens when cooled to form the melt matte 118.

After the bristles are secured to the head plate 141, the head plate 141 is secured to the base portion 160 of the head 120 such as by ultrasonic welding. When the head plate 141 is coupled to the head 120, the melt matte 118 is located between the lower surface 143 of the head plate 141 and a basin floor 162 of a basin cavity 161 of the head 120 in which the head plate 141 is disposed (discussed in more detail below). The melt matte 118, which is coupled directly to and in fact forms a part of the tooth cleaning elements 115, prevents the tooth cleaning elements 115 from being pulled through the tuft holes 144 in the head plate 141 thus ensuring that the tooth cleaning elements 115 remain attached to the head plate 141 during use of the personal care implement 100. This technique for mounting the tooth cleaning elements 115 to the head 120 via the head plate 141 is generally known as anchor free tufting (AFT).

In another embodiment, the tooth cleaning elements 115 may be connected to the head 120 using a technique known in the art as AMR. In this technique, the handle is formed integrally with the head plate as a one-piece structure. After the handle and head plate are formed, the tooth cleaning elements are inserted into holes in the head plate so that free/cleaning ends of the tooth cleaning elements extend from the front surface of the head plate and bottom ends of the tooth cleaning elements are adjacent to the rear surface of the head plate. After the tooth cleaning elements are inserted into the holes in the head plate, the bottom ends of the tooth cleaning elements are melted together by applying heat thereto, thereby forming a melt matte at the rear surface of the head plate. After the heat is no longer applied, the melted bottom ends of the tooth cleaning elements solidify/harden to form the melt matte/thin layer of plastic. In some embodiments, after formation of the melt matte, a tissue cleaner is injection molded onto the rear surface of the head plate, thereby trapping the melt matte between the tissue cleaner and the rear surface of the head plate. In other embodiments, other structures may be coupled to the rear surface of the head plate to trap the melt matte between the rear surface of the head plate and such structure without the structure necessarily being a tissue cleaner. The structure can just be a plastic material that is used to form a smooth rear surface of the head, or the like, and the structure can be molded onto the rear surface of the head plate or snap-fit (or other mechanical coupling) to the rear surface of the head plate as desired.

Of course, techniques other than AFT and AMR can be used for mounting the tooth cleaning elements 115 to the head 120, such as widely known and used stapling techniques or the like. In such embodiments the head plate 141 may be omitted and the tooth cleaning elements 115 may be coupled directly to the head 120. Furthermore, in a modified version of the AFT process discussed above, the head plate 141 may be formed by positioning the tooth cleaning elements 115 within a mold, and then molding the head plate 141 around the tooth cleaning elements 115 via an injection molding process.

Although not illustrated herein, in certain embodiments the head 120 may also include a soft tissue cleanser coupled to or positioned on its rear surface 123. An example of a suitable soft tissue cleanser that may be used with the present invention and positioned on the rear surface 123 of the head 120 is disclosed in U.S. Pat. No. 7,143,462, issued Dec. 5, 2006 to the assignee of the present application, the entirety of which is hereby incorporated herein by reference. In certain other embodiments, the soft tissue cleanser may include protuberances, which can take the form of elongated ridges, nubs, or combinations thereof. Of course, the invention is not to be so limited and in certain embodiments the personal care implement 100 may not include any soft tissue cleanser.

Referring now to FIGS. 2, 3, 7 and 8 concurrently, the personal care implement 100 will be further described. The body 101 of the personal care implement 100 contains a supply 190 of a first fluid 103. In the exemplified embodiment, the supply 190 includes a reservoir 102, a capillary member 220, and a delivery member 170 extending between the reservoir 102 and the capillary member 220 for carrying the first fluid 103 from the reservoir 102 to the capillary member 220. The body 101, and specifically the handle 110 in the exemplified embodiment, of the personal care implement 100 has an inner surface 106 that defines the reservoir 102 that contains a store 109 of the first fluid 103. The body, and more specifically the head 120 in the exemplified embodiment, of the personal care implement 100 contains a capillary member 220 that is fluidly coupled to the store 109 of the first fluid 103 in the reservoir 102 via the delivery member 170. In the exemplified embodiment, the reservoir 102 is located entirely within the handle 110 of the body 101. However, the invention is not to be so limited in all embodiments and in certain other embodiments the reservoir 102 may be located partially or entirely within the head 120 of the body 101 (an example of which is discussed below with reference to FIG. 13).

The body 101 of the personal care implement 100 comprises an opening 126 through which the first fluid 103 can be dispensed onto a biological surface as described in more detail below. In the exemplified embodiment, the opening 126 is formed in the head 120 of the personal care implement 100, and more specifically the rear surface 123 of the head 120. However, the invention is not to be so limited in all embodiments and in other embodiments the opening 126 could be located at other positions along the body 101 as desired. However, locating the opening 126 on the rear surface 123 of the head 120 promotes dispensing of the first fluid 103 during normal toothbrushing operation as the rear surface 123 of the head 120 engages a user's oral surfaces.

Regardless of its exact positioning, the opening 126 is in fluid communication with the store 109 of the first fluid 103 located within the reservoir 102. Specifically, a fluid passageway is formed from the exterior adjacent to the rear surface 123 of the head 120 through the opening 126, from the opening 126 into the basin cavity 161, and from the basin cavity 161 into the reservoir 102. Thus, the first fluid 103 stored within the reservoir 102 can flow from the reservoir 102 and out to a user's oral cavity or other biological surface as desired and then through the opening 126, as discussed in more detail below. More specifically, due to the components located within the reservoir 102 (i.e., the delivery member 170) and within the basin cavity 161 (a capillary member 220), the first fluid 103 may passively flow, via capillary action or the like, from the reservoir 102 to the capillary member 220 and through the opening 126 for dispensing to a biological surface such as the user's oral cavity. Thus, in certain embodiments no pumps are required for dispensing of the first fluid 103 but rather the dispensing occurs naturally and passively during toothbrushing. As noted above, the opening 126 is not required to be located in the head 120 in all embodiments and there are other possibilities for the location of the opening 126 in other embodiments.

The first fluid 103 that is stored in the reservoir 102 and the capillary member 220 (i.e., the first fluid 103 of the supply 190) can be any type of fluid that is desired to be applied to a biological surface. For example, when the biological surface is a user's oral cavity, the first fluid 103 may be one that provides a benefit to a user (i.e., a benefit agent) such as a sensorial or therapeutic benefit. For example without limitation, the first fluid 103 may be a mouthwash, a dentifrice, a tooth whitening agent such as peroxide containing tooth whitening compositions, or the like. Other contemplated fluids that can be stored in the reservoir 102 include, for example without limitation, antibacterial agents; oxidative or whitening agents; enamel strengthening or repair agents; tooth erosion preventing agents; tooth sensitivity ingredients; gum health actives; nutritional ingredients; tartar control or anti-stain ingredients; enzymes; sensate ingredients; flavors or flavor ingredients; breath freshening ingredients; oral malodor reducing agents; anti-attachment agents or sealants; diagnostic solutions; occluding agents, dry mouth relief ingredients; catalysts to enhance the activity of any of these agents; colorants or aesthetic ingredients; and combinations thereof. In certain embodiments the oral care material is free of (i.e., is not) toothpaste. Instead, the oral care material in such embodiments is intended to provide benefits in addition to merely brushing one's teeth. Other suitable oral care materials could include lip balm or other materials that are typically available in a semi-solid state. Furthermore, in still other embodiments the first fluid 103 can be a natural ingredient, such as for example without limitation, lotus seed; lotus flower, bamboo salt; jasmine; corn mint; camellia; aloe; gingko; tea tree oil; xylitol; sea salt; vitamin C; ginger; cactus; baking soda; pine tree salt; green tea; white pearl; black pearl; charcoal powder; nephrite or jade and Ag/Au+. In still other embodiments where the personal care implement 100 is not a toothbrush, the first fluid 103 can be any other type of fluid that's dispensing is desired to assist or enhance use of the implement, such as hair gel, make-up (i.e., mascara or the like), shaving cream, or the like.

As noted above, the personal care implement 100 includes the end cap 130 that is coupled to the proximal end 111 of the handle 110. In the exemplified embodiment, the end cap 130 is coupled to the proximal end 111 of the handle 110 via a threaded screw attachment. Of course, the invention is not to be so limited in all embodiments and in certain other embodiments interference fit, tight fit and other connection techniques can be used to detachably couple the end cap 130 to the handle 110. As illustrated in FIG. 2, when the end cap 130 is separated from the handle 110, an opening 119 is exposed at the proximal end 111 of the handle 110 that provides access into the reservoir 102 within the handle 110. Thus, removing the end cap 130 from the handle 110 can enable a user to refill the reservoir 102 with the first fluid 103 or with a different fluid as needed or desired. Of course, as noted above in other embodiments the end cap 130 may be omitted and in such embodiments upon depleting the first fluid 103 within the reservoir 102, the personal care implement 100 can be used as a conventional toothbrush (or other type of implement such as hairbrush, razor, etc.) without the benefits of the first fluid 103, the personal care implement 100 can be discarded, or the reservoir 102 can be refilled through the opening 126. In certain embodiments, depletion of the first fluid 103 is achieved after a number of uses upon which it is generally desired to dispose of the personal care implement 100, such as for example without limitation after three months of use.

Referring to FIGS. 2, 3, and 8 concurrently, the structure and components of the head 120 of the personal care implement 100 will be further described. The head 120 comprises the base portion 160 comprising the basin cavity 161 as noted above. The basin cavity 161 is defined by the floor 162 and a sidewall 163 extending upwardly from the floor towards an open top end 164 that marks the termination of the basin cavity 161. In the exemplified embodiment, the opening 126 is formed into the floor 162 of the basin cavity 161 and provides a passageway from the exterior adjacent the rear surface 123 of the head 120 into the basin cavity 161. Thus, the head 120 includes a passageway entirely through it from the front surface 122 to the rear surface 123 by virtue of the open top end 164 of the basin cavity 161 and the opening 126 in the rear surface 123 of the head 120.

The personal care implement 100 also comprises a divider member 210, the capillary member 220 of the supply 190, and a flow barrier 230. More specifically, in the exemplified embodiment the divider member 210, the capillary member 220, and the flow barrier 230 are located in the head 120 and assist in the dispensing the first fluid 103 from the reservoir 102 to the biological surface or oral cavity while preventing backflow. Specifically, as described in greater detail below, the first fluid 103 flows from the reservoir 102 to the capillary member 220 via the delivery member 170 and then because the capillary member 220 is adjacent the opening 126, the first fluid 103 can flow from the capillary member 220 (which may be a sponge-like material) to the biological surface.

As described in greater detail below, the flow barrier 230 permits flow of the first fluid 103 from the capillary member 220 through the flow barrier 230 and the opening 126 while inhibiting the backflow of liquid, such as water, saliva, toothpaste slurry, or the like, through the flow barrier 230 and into the capillary member 220. Specifically, one potential issue with passive/capillary fluid dispensing systems such as this one is that while fluid is permitted to flow out from the reservoir for dispensing, other undesirable fluids may also be capable of flowing into the reservoir from the exterior environment. For example, while rinsing the head 120 of the personal care implement 100, water may pass through the opening 126, into the capillary member 220, through the delivery member 170, and into the reservoir 102. As another example, while brushing the oral cavity/teeth with the personal care implement 100, saliva and/or toothpaste slurry may pass through the opening 126 into the capillary member 220, through the delivery member 170, and into the reservoir 102. Specifically, without the flow barrier 230, if fluid can flow out of a capillary flow system it is generally also capable of flowing in. The flow barrier 230 operates as a flow control mechanism that permits the outflow of the first fluid 103 from the reservoir 102 to the biological surface or oral cavity while substantially preventing or inhibiting the backflow of water, saliva, toothpaste slurry, or the like back into the device and reservoir 102.

The divider member 210 divides the basin cavity 161 into an upper chamber 181 in which the head plate 141 is located and a lower chamber 182 in which the capillary member 220 (loaded with the first fluid 103) and the flow barrier 230 are located. In the exemplified embodiment, the divider member 210 comprises a main body 211 and a protrusion 212 extending therefrom. As will be described in more detail below, in the exemplified embodiment the protrusion 212 of the divider member 210 contacts the capillary member 220 and forces a portion of the capillary member 220 to extend into and through the opening 126 so that it protrudes from the rear surface 123 of the head 120. Of course, this is not required in all embodiments and the divider member 210 may be a flat plate in other embodiments and the capillary member 220 may protrude from the rear surface 123 of the head 120 due to its shape alone, or it may not protrude at all. Furthermore, in some embodiments as discussed in detail below with reference to FIG. 13, the capillary member 220 is not a structure that is capable of protruding through an opening but rather it is simply a reservoir for holding the first fluid 103 within the head 120.

In the exemplified embodiment, the capillary member 220 is formed of a capillary material that is capable of being loaded with the first fluid 103. For example, the capillary member 220 may be a porous foam such as including without limitation a polyurethane foam or other open cell porous material. Thus, in the exemplified embodiment the capillary member 220 can be formed of any type of material through which a liquid can travel via capillary action or capillary flow. Specifically, the capillary material can be a porous material, a fibrous material, a foam material, a sponge material, natural fibers, sintered porous materials, porous or fibrous polymers or other materials which conduct the capillary flow of liquids. Of course, the capillary material is not to be limited by the specific materials noted herein in all embodiments, but can be any material that facilitates movement of a liquid therethrough via capillary action. Furthermore, although described herein as being formed of a capillary material, the invention is not to be so limited in all embodiments and some alternative embodiments will be described herein below. For example, in certain embodiments the capillary member 220 may be formed of a plastic material or a rubber material and may have an orifice formed therethrough to enable the oral care material to flow through the capillary member 220 for application to a biological surface such as a user's oral cavity, facial surfaces, or the like. In other embodiments the capillary member 220 may be an empty reservoir or cavity that stores the first fluid 103.

The capillary member 220 may be formed of a compressible material so that the application of force onto the capillary member 220 causes the capillary member 220 to compress/deform in its shape. When the capillary member 220 is loaded with the first fluid 103, compressing the capillary member 220 results in some of the first fluid 103 being dispensed from the capillary member 220 similar to how liquid is removed from a sponge when the sponge is squeezed or compressed. Of course, as noted above and described in more detail below with reference to FIG. 13, the invention is not limited to the capillary member 220 being a porous foam material in all embodiments and it may instead simply be a reservoir that retains the first fluid 103.

In the embodiment exemplified in FIGS. 2, 3, and 8, the capillary member 220, which is formed of a capillary material such as a porous foam, comprises a front surface 221 and an opposite rear surface 222. The capillary member 220 is located within the basin cavity 161 with the rear surface 222 of the capillary member 220 adjacent to the divider member 210 and the front surface 221 of the capillary member 220 facing the rear surface 123 of the head 120. More specifically, the protrusion 212 of the divider member 210 abuts against the rear surface 222 of the capillary member 220. In its natural form, in the exemplified embodiment the capillary member 220 has a flat/planar front surface 221 and a flat/planar rear surface 222. When in the basin cavity 161, the protrusion 212 abuts against the rear surface 222 of the capillary member 220 and forces the capillary member 220 to compress into and through the opening 126 in the rear surface 123 of the head 120. Thus, as best seen in FIG. 8, the capillary member 220 protrudes from the body 101, and more specifically in the exemplified embodiment extends into and protrudes through the opening 126 so that it extends from the rear surface 123 of the head 120. Because the capillary member 220 protrudes from the rear surface 123 of the head 120, when a user is brushing his/her teeth the capillary member 220 will contact the user's oral cavity surfaces. This contact will cause the capillary member 220 to compress during use, which will result in dispensing of the first fluid 103 loaded onto the capillary member 220. As the first fluid 103 in the capillary member 220 becomes depleted it is replenished with additional and equal amounts of the first fluid 103 stored within the reservoir 102 as described more fully below.

The flow barrier 230 has a first surface 232 and an opposite second surface 231. In the exemplified embodiment, the flow barrier 230 comprises an apertured film 233. For example, the flow barrier 230 may be formed from a punctured or otherwise apertured polyethylene film material. Stated another way, in some embodiments the flow barrier 230 is formed of a plastic material that has apertures formed therein. In some embodiments, the flow barrier 230 is flexible and/or compressible. The apertures are specifically designed to permit flow of the first fluid 103 therethrough while preventing backflow of a second fluid (such as water, saliva, toothpaste slurry, or the like) during static and ambient conditions and substantially inhibiting backflow of the second fluid even during a compressed or non-static condition. The flow barrier 230 is positioned within the basin cavity 161 with the first surface 232 of the flow barrier 230 adjacent to the front surface 221 of the capillary member 220 and the second surface 231 of the flow barrier 230 facing and/or protruding from the rear surface 123 of the head 120. A portion of the flow barrier 230 will protrude from the rear surface 123 of the head 120 via the opening 126 because it is layered onto the capillary member 220 which also protrudes from the rear surface 123 of the head 120 via the opening 126.

The flow barrier 230 may wrap around portions of the capillary member 220, it may cover the entirety of the front surface 221 of the capillary member 220, it may cover portions of the front surface 221 of the capillary member 220, or it may simply cover/close the entirety of the opening 126. In certain embodiments, the flow barrier 230 is laminated or otherwise made to wrap around the capillary member 220 to couple the flow barrier 230 to the capillary member 220. Then, the capillary member 220 with the flow barrier 230 coupled thereto is inserted into the basin cavity 161 as described herein. The first fluid 103 loaded onto the capillary member 220 must pass through the flow barrier 230 in order to be dispensed through the opening 126 and onto a biological surface. Thus, the capillary member 220 is entirely sealed within the basin cavity 161 of the head 120 and flow of the first fluid 103 out of the capillary member 220 is controlled by the flow barrier 230.

Figure 4:
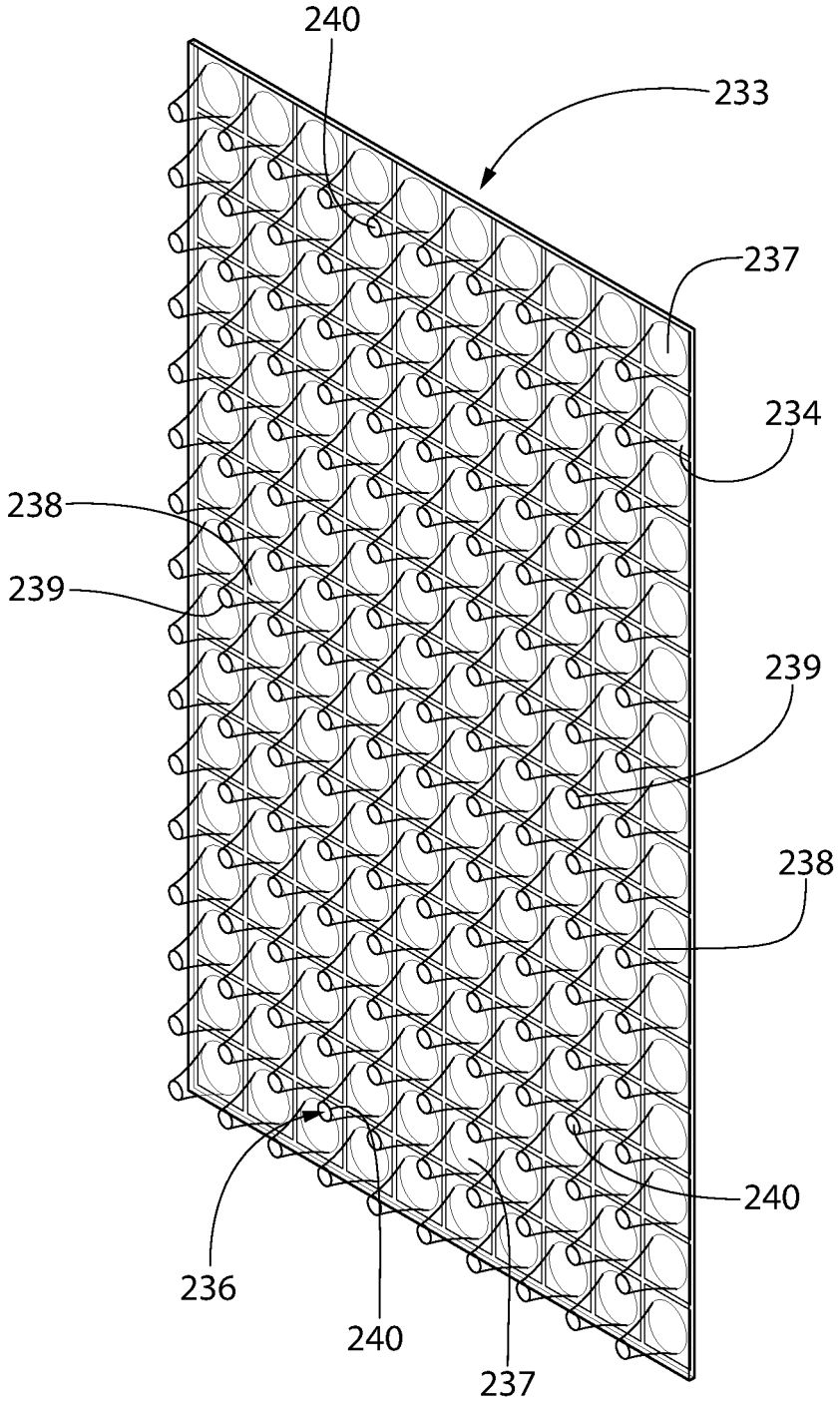
FIG. 4 is a front perspective view of an apertured film in accordance with an embodiment of the present invention.
Figure 5:
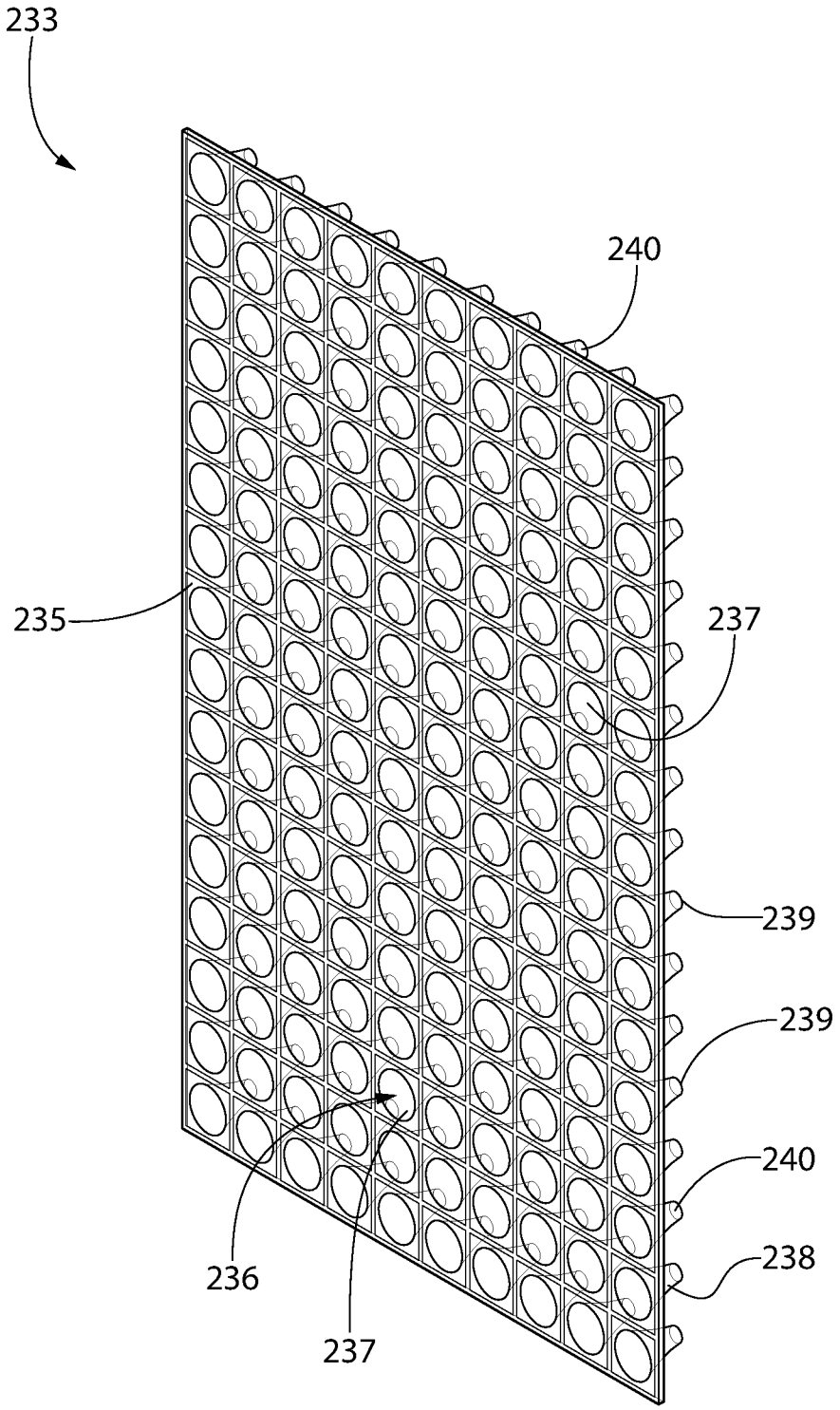
FIG. 5 is a rear perspective view of the apertured film of FIG. 4.

Referring to FIGS. 4 and 5 concurrently, the flow barrier 230, specifically when formed as an apertured film 233, will be described in more detail. The apertured film 233 comprises a first surface 235 and an opposite second surface 234. In the exemplified embodiment, the first surface 235 of the apertured film 233 is the first surface 232 of the flow barrier 230 and the second surface 234 of the apertured film 233 is the second surface 231 of the flow barrier 230. However, this is not always the case. For example, as discussed in greater detail below with reference to FIG. 10, the flow barrier 230 may comprise multiple apertured films such that the first surface of one of the apertured films forms the first surface 232 of the flow barrier 230 and the second surface of another one of the apertured films forms the second surface 231 of the flow barrier 230.

However, as regards the embodiment exemplified in FIGS. 4 and 5, the apertured film 233 forms the flow barrier 230 by itself and thus those two components share first and second (i.e., front and rear) surfaces. The apertured film 233 comprises a plurality of apertures 236 extending therethrough from the first surface 235 to the second surface 234. In one embodiment, the apertured film 233 may comprise a homogenous distribution of the apertures 236 along an entirety of its first and second surfaces 235, 234.

In the exemplified embodiment, the apertured film 233 comprises a plurality of protuberances 238 extending from the second surface 234, each of the plurality of protuberances 238 terminating at a distal end 239. Each of the protuberances 238 has a height measured from the second surface 234 of the apertured film 233 to the distal end 239 of the protuberance 238. In certain embodiments, the height may in a range of 260-300 microns, more specifically 270-290 microns, and still more specifically 275-285 microns. In other embodiments, the height may be in a range of 580-640 microns, more specifically 590-630 microns, and still more specifically 595-625 microns. The protuberances 238 are conical in the exemplified embodiment but may take on other shapes in other embodiments. In the exemplified embodiment, each of the apertures 236 extends through one of the plurality of protuberances 238. Stated another way, each of the protuberances 238 has one of the apertures 236 extending therethrough. In some other embodiments, the protuberances 238 may be omitted and the apertured film 233 may still function as described herein.

Each of the apertures 236 extends from a first opening 237 in the first surface 235 of the apertured film 233 to a second opening 240 in the second surface 234 of the apertured film. In the exemplified embodiment, the second openings 240 are located at the distal ends 239 of the protuberances 238. However, in other embodiments the apertured film 233 may not include the protuberances 238 and instead the second openings 240 can be located directly on the second surface 234 of the apertured film 233.

In the exemplified embodiment, the first openings 237 have a first transverse area and the second openings 240 have a second transverse area such that the first transverse area is greater than the second transverse area. One or both of the first and second openings may have various shapes including various polygonal shapes, circular, elliptical, or the like. For example, in certain embodiments the first openings 237 may have a first transverse area (i.e., diameter) in a range of 250-350 microns, and in another embodiment the first openings 237 may have a first transverse area (i.e., diameter) in a range of 500-625 microns. The second openings 240 may have a second transverse area (i.e., diameter) in a range of 435-480 microns, or between 600-640 microns. Of course, the invention is not to be particularly limited by the size of these openings in all embodiments and they might be outside of the noted ranges in other embodiments. In certain embodiments, each of the first and second openings 237, 240 are biased into their open states such that in a natural state without any forces being applied to the first and second openings 237, 240, those openings are open. Thus, these are different from a typical valve which is biased into a closed state and only opens upon some action occurring to force them open.

Thus, each of the apertures 236 tapers from the first opening 237 to the second opening 240 so that the first openings 237 are larger, or have a larger transverse area, than the second openings 240. In the exemplified embodiment the apertures 236 are formed through the protuberances 238 and the apertures 236 taper due to the conical shape of the protuberances 238. In other embodiments that do not include the protuberances 238 the apertures 236 may still taper as they extend from the first surface 235 of the apertured film 233 to the second surface 234 of the apertured film 233. Thus, even without the protuberances 238, the apertures 236 may terminate at first openings 237 that are larger than the second openings 240. The difference in the transverse area of the first and second openings 237, 240 facilitates permitting the first fluid 103 to pass into the first openings 237 and through the apertures 236 for dispensing while preventing or inhibiting flow of a second fluid (i.e., water, saliva, toothpaste slurry, or the like) into the second openings 240 and through the apertures 236 under certain conditions as described more fully below.

Thus, one specific mechanism for achieving the allowance of flow of the first fluid 103 in one direction under certain conditions and prevention of flow of another fluid in an opposite direction is with the use of the apertured film 233. However, the exemplified embodiment is merely one mechanism for achieving this. Specifically, in other embodiments the flow barrier 230 may have opposing first and second surfaces each of which has a different surface property or characteristic so that the surface property of the first surface permits flow of a fluid through the flow barrier 230 from the first surface under certain conditions while the surface property of the second surface prevents flow of a fluid through the flow barrier 230 from the second surface under certain conditions. For example, a first surface of the flow barrier 230 may be hydrophilic and thereby permit a fluid to pass through the flow barrier 230 from the first surface while a second surface of the flow barrier 230 may be hydrophobic and thereby prevent a fluid to pass through the flow barrier 230 from the second surface. Alternatively, the first surface of the flow barrier 230 may be formed of a first material that permits a fluid to pass through the flow barrier 230 from the first surface while the second surface of the flow barrier 230 may be formed of a second material that is different from the first material and that prevents a fluid from passing through the flow barrier 230 from the second surface. Thus, although the apertured film 233 is shown in the exemplified embodiment as the flow barrier 230, other mechanisms, structures, components, and the like may be used as the flow barrier 230 in other embodiments while still achieving the same purpose in function.

Returning back to the exemplified embodiment, each of the apertures 236 is spaced apart from the adjacent apertures 236 by non-punctured portions of the apertured film 233. In certain embodiments, the apertured film 233 may have between ten and fifty of the apertures 236 per linear inch. In other embodiments, the apertured film 233 may have between twenty and forty of the apertures 236 per linear inch. In one particular embodiment, the apertured film 233 may have approximately twenty of the apertures 236 per linear inch. In another particular embodiment, the apertured film 233 may have approximately forty of the apertures 236 per linear inch. It should be appreciated that the density and size of the apertures 236 is not to scale in the drawings in all embodiments. Of course, the above are merely exemplary and in some embodiments the number/density of the apertures 236 may be outside of the noted ranges so long as the functionality described herein is achieved.

In the exemplified embodiment, the apertured film 233 is illustrated as being transparent. However, the invention is not to be so limited in all embodiments and the apertured film 233 may have any desired color including being transparent, translucent, opaque, colorless, or any color. This may be done for aesthetic purposes and/or to match the color of the apertured film 233 with the color of the remainder of the personal care implement 100 or with the color of the first fluid 103 being dispensed therefrom.

As noted above, the apertured film 233 may be formed of a polyethylene film. In one embodiment, the apertured film 233 may be a resilient plastic web that exhibits a three-dimensional microstructure having a plurality of openings or capillary networks therein. The capillary networks are of a decreasing size in the direction from the first surface 235 to the second surface 234 to promote fluid transport from the first surface 235 to the second surface 234 while inhibiting the flow of fluid in the reverse direction. Thus the film 233 is a continuous film having a large number of the apertures 236 therein.

Figure 6C:
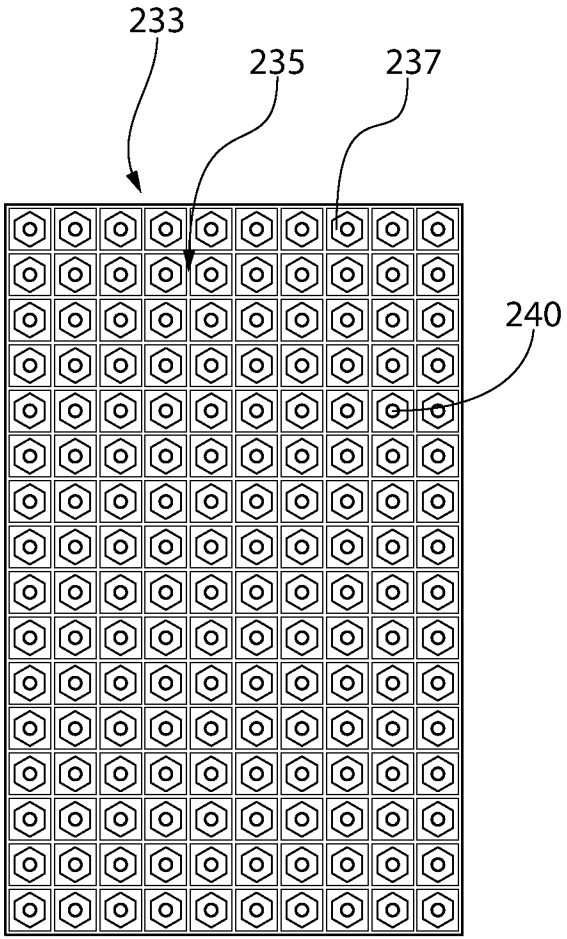
FIGS. 6A-6C are alternative rear views of the apertured film of FIG. 4 illustrating different shaped openings therein.
Figure 6B:
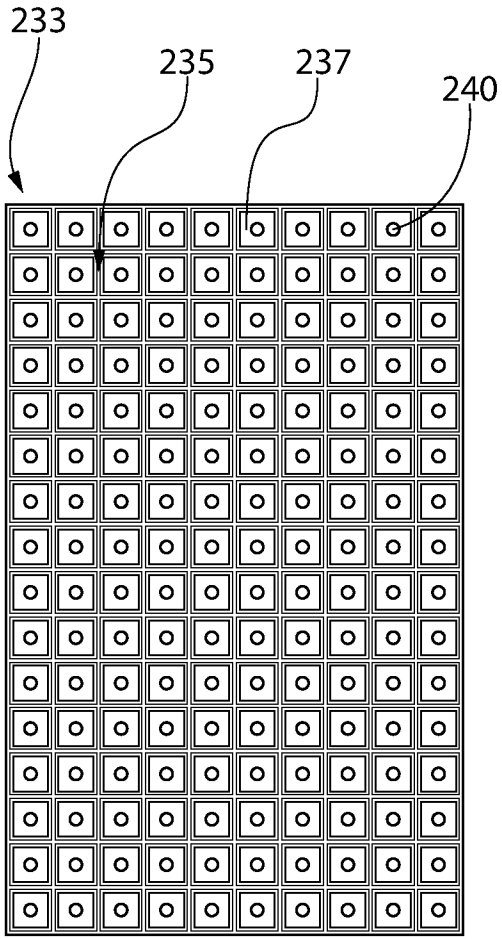
Figure 6A:
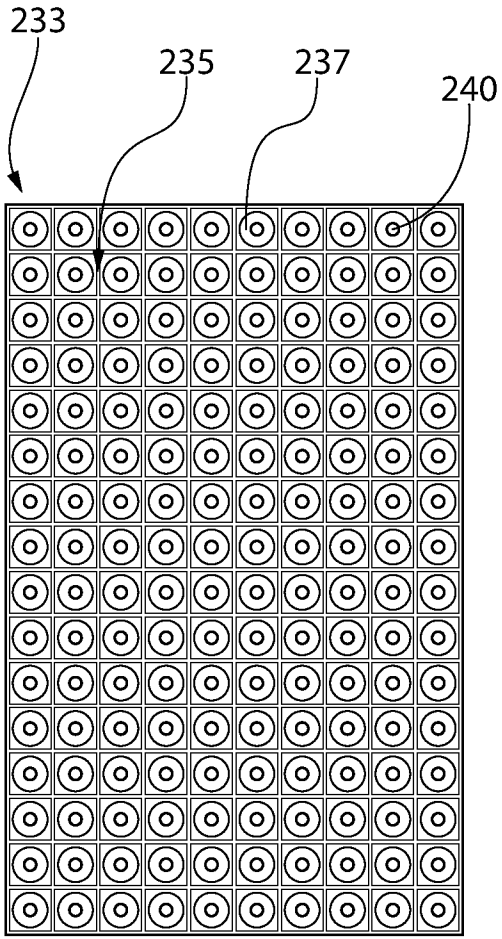

Referring briefly to FIGS. 6A-6C, different variations of the apertured film 233 are illustrated to show different shapes for the first openings 237 of the apertures 236 on the first surface 235 of the apertured film 233. Specifically, FIG. 6A illustrates the apertured film 233 having round or circular first openings 237. FIG. 6B illustrates the apertured film 233 having square or rectangular shaped first openings 237. FIG. 6C illustrates the apertured film 233 having hexagonal shaped first openings 237. Any of these and other variations in the shape of the first openings 237 are possible in various different embodiments. Furthermore, although each of FIGS. 6A-6C illustrates the second openings 240 of the apertures 236 as having a round shape, this is not required in all embodiments and this shape may also be modified in other embodiments.

Figure 7:
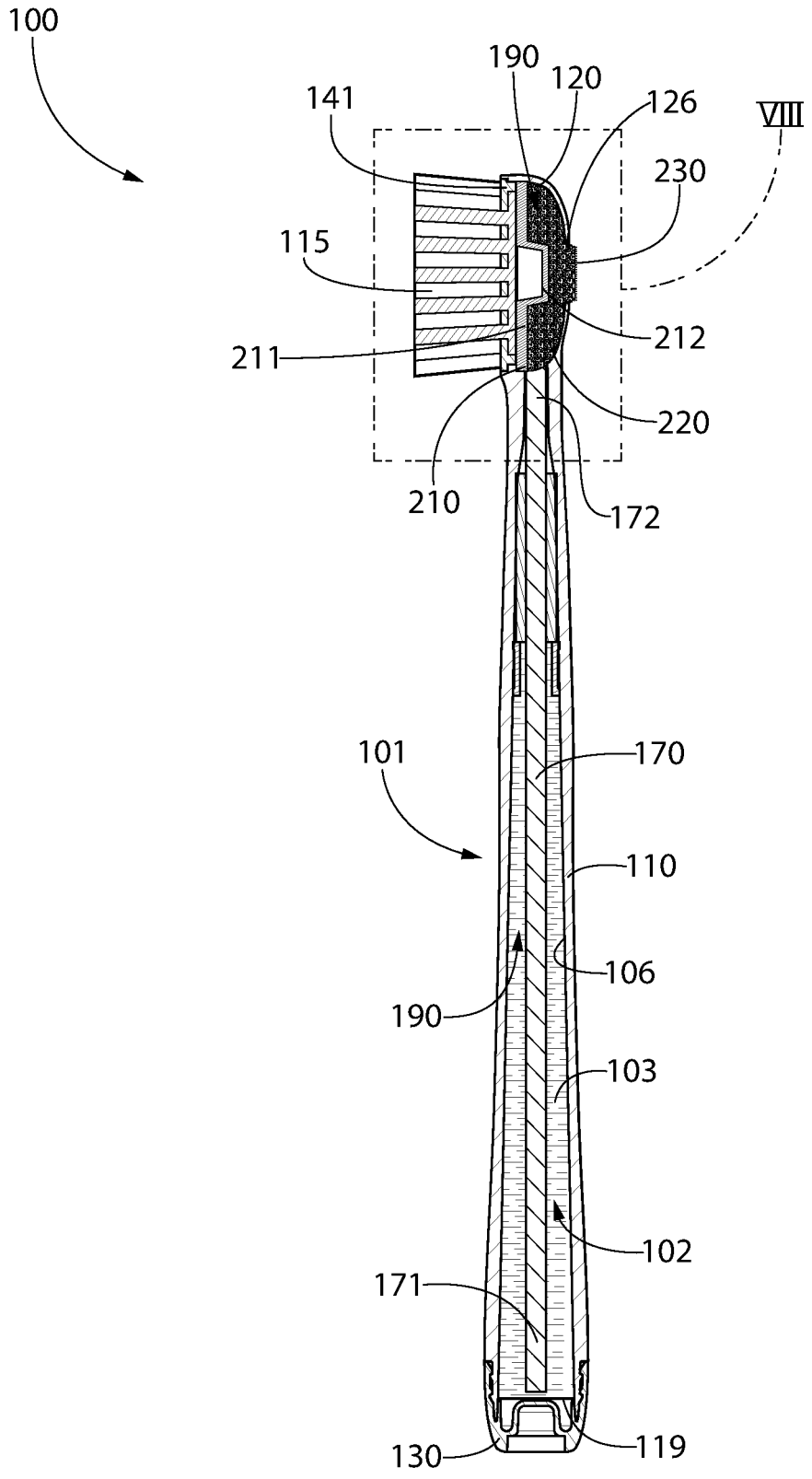
FIG. 7 is a cross-sectional view taken along line VII-VII of FIG. 2.
Figure 8A:
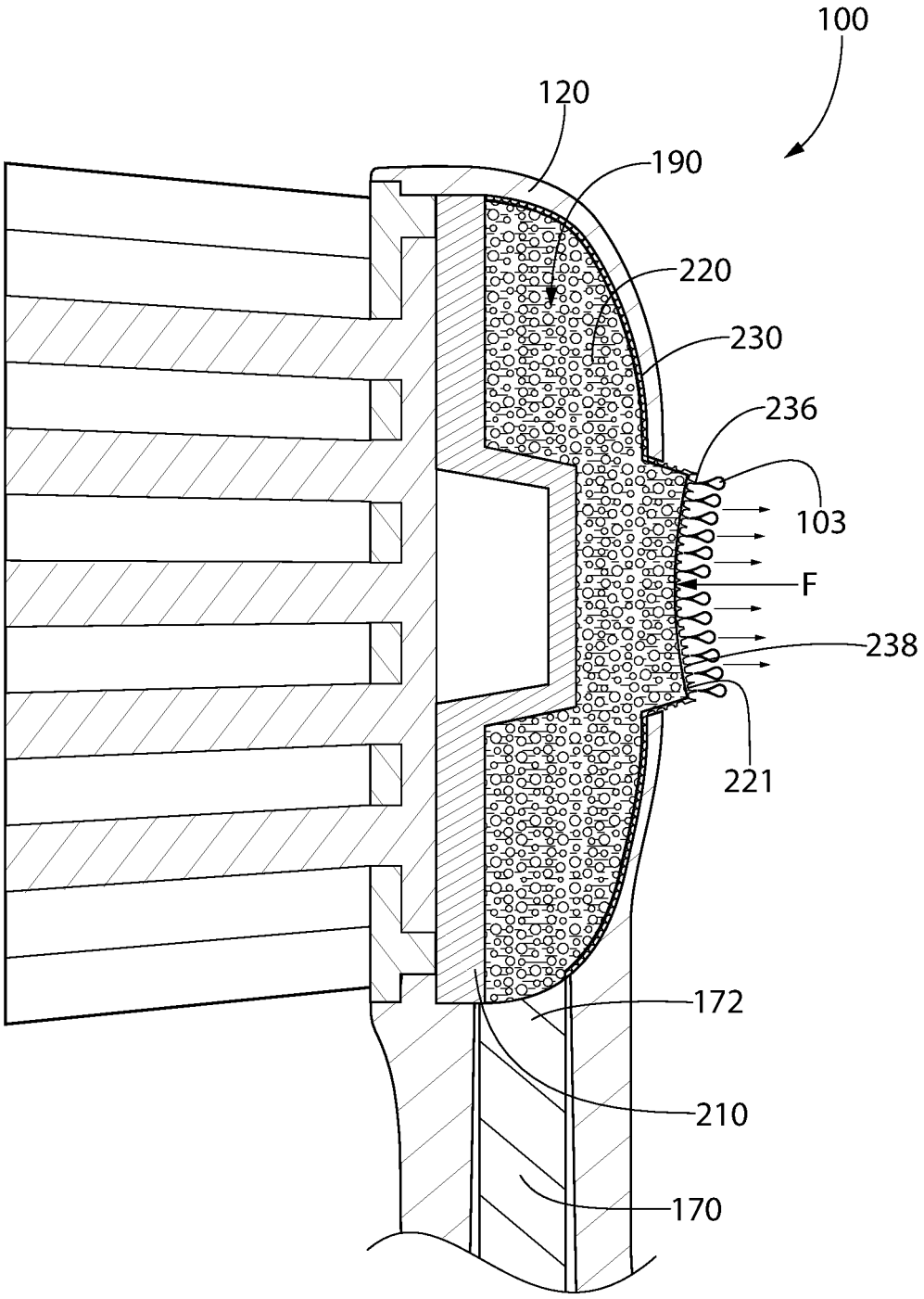
FIG. 8A is the close-up view of FIG. 8 illustrating the apertured film in a compressed state.

Referring now to FIGS. 7-8A concurrently, some additional structure of the personal care implement 100 and its function/operation will be described. As noted above, the divider member 210 divides the basin cavity 161 into an upper chamber 181 and a lower chamber 182. The head plate 141 and the melt matte 118 are located in the upper chamber 181. The capillary member 220 and the flow barrier 230 are located in the lower chamber 182. The divider member 210 creates a seal between the upper and lower chambers 181, 182 so that the first fluid 103 in the capillary member 220 cannot pass into the upper chamber 181. Specifically, the capillary member 220 is sealed within the lower chamber 182 between the divider member 210 and the flow barrier 230 so that in order for the first fluid 103 in the capillary member 220 to be dispensed it must pass through the flow barrier 230. The head plate 141 in this embodiment closes the open top end 164 of the basin cavity 161. The flow barrier 230 extends across and covers/closes the opening 126 in the rear surface 123 of the head 120. The flow barrier 230 permits the first fluid 103 to pass through it under certain circumstances as described in more detail below, and thus the first fluid 103 has an exit passageway through the flow barrier 230.

In the exemplified embodiment, the capillary member 220 is a relatively small structure such that it fits entirely within the head 120 of the personal care implement 100. Furthermore, as noted above in the exemplified embodiment the store 109 of the first fluid 103 is located within the reservoir 102 in the handle 110 of the personal care implement 100. Thus, the capillary member 220 does not extend all the way into the reservoir 102, and no portion of the capillary member 220 is in direct contact with the store 109 of the first fluid 103 within the reservoir 102. However, the capillary member 220 is fluidly coupled to the store 109 of the first fluid 103 within the reservoir 102 as described herein below so that the capillary member 220 is loaded with the first fluid 103. Of course, in other embodiments the capillary member 220 may extend into the reservoir 102 in order to load the capillary member 220 with the first fluid 103.

In the exemplified embodiment, fluid coupling between the capillary member 220 and the store 109 of the first fluid 103 is achieved via the delivery member 170. In the exemplified embodiment, the delivery member 170 is disposed within the personal care implement 100 and extends from the reservoir 102 to the capillary member 220. Specifically, the delivery member 170 has a first end portion 171 that is in contact with (or positioned within) the store 109 of the first fluid 103 in the reservoir 102 and a second end portion 172 that is in contact with the capillary member 220. More specifically, in the exemplified embodiment the second end portion 172 of the delivery member 170 extends through an opening 189 formed into the sidewall 163 of the basin cavity 161 (see FIG. 3). Thus, when the capillary member 220 is positioned within the lower chamber 182 of the basin cavity 161 as discussed herein above, the capillary member 220 is also in surface contact with the second end portion 172 of the delivery member 170. This enables fluid to flow from the delivery member 170 through the second end portion 172 and into the capillary member 220 (via a wicking action, capillary action, or the like).

In the exemplified embodiment, the delivery member 170 is a capillary tube that is configured to deliver the first fluid 103 from the store 109 to the capillary member 220 (i.e., capillary member) via a wicking action. Thus, the delivery member 170 may have a passageway extending therethrough from the first end portion 171 to the second end portion 172 that permits fluid to flow upwardly therewithin from the store 109 to the capillary member 220. The passageway may have a cross-sectional size and shape that permits flow of the fluid all the way from the store 109 to the capillary member 220 to ensure that the capillary member 220 remains loaded with the first fluid 103. Thus, as the capillary member 220 becomes depleted of the first fluid 103, the delivery member 170 will transport additional amounts of the first fluid 103 from the reservoir 102 to the capillary member 220 to replenish the capillary member 220. It is possible that the replenishment may take a longer period of time than the period of time that it takes to deplete the capillary member 220 of the first fluid 103. Thus, this may serve as a dosage limiter in that during a single toothbrushing session only the amount of the first fluid 103 that is loaded onto the capillary member 220 is dispensed because it takes longer for the capillary member 220 to become reloaded. In alternative embodiments, the delivery member 170 may itself be formed of a capillary material such as the exemplary materials described above with regard to the capillary member 220 to facilitate the occurrence of the noted wicking action.

In certain embodiments, the delivery member 170 has a capillary structure which may be formed in numerous configurations and from numerous materials operable to produce fluid flow via capillary action. In one non-limiting embodiment, the delivery member 170 may be configured as a tube or lumen having an internal open capillary passageway extending between ends of the capillary member which is configured and dimensioned in cross section to produce capillary flow. The lumen or open capillary passageway may have any suitable cross sectional shape and configuration. In such embodiments the delivery member 170 may be formed of a porous material as described below or a non-porous material (e.g., plastics such as polypropylene, metal, rubber, or the like). In other non-limiting embodiments, delivery member 170 may be formed of a porous and/or fibrous material of any suitable type through which a fluid can travel via capillary action or flow. Examples of suitable materials include without limitation fibrous felt materials, ceramics, and porous plastics with open cells (e.g. polyurethane, polyester, polypropylene, or combinations thereof) including such materials as those available from Porex Technologies, Atlanta, Ga. The capillary member material may therefore be a porous material, a fibrous material, a foam material, a sponge material, natural fibers, sintered porous materials, porous or fibrous polymers or other materials which conduct the capillary flow of liquids. Of course, the capillary material is not to be limited by the specific materials noted herein in all embodiments, but can be any material that facilitates movement of a liquid therethrough via capillary action. A mixture of porous and/or fibrous materials may be provided which have a distribution of larger and smaller capillaries. The delivery member 170 can be formed from a number of small capillaries that are connected to one another, or as a larger single capillary rod. The capillary member whether formed as a lumen or of porous or fibrous materials may have any suitable polygonal or non-polygonal cross sectional shape including for example without limitation circular, elliptical, square, triangular, hexagonal, star-shaped, etc. The invention is not limited by the construction, material, or shape of the capillary member.

Due to the delivery member 170 being a capillary tube that is in direct contact with the first fluid 103 in the store 109, the delivery member 170 transports the first fluid from the store 109 to the capillary member 220. Specifically, the first fluid 103 in the store 103 flows up the delivery member 170 from the first end 171 to the second end 172. The first fluid 103 then flows from the second end 172 of the delivery member 170 and into the capillary member 220 due to the surface contact between the second end 172 of the delivery member 170 and the capillary member 220. Once the capillary member 220 becomes saturated with the first fluid 103, flow of the first fluid 103 will cease until some of the first fluid 103 is removed from the capillary member 220. Finally, the first fluid 103 flows from the capillary member 220, through the flow barrier 130 or apertured film 133, and through the opening 126 for application to a biological surface when certain conditions are met as described below. As the first fluid 103 is dispensed from the capillary member 220, additional amounts of the first fluid 103 are transported from the reservoir 102 to the capillary member 220 as described herein until the capillary member 220 becomes once again reloaded and/or saturated with the first fluid 103. In an exemplary embodiment, during use of the personal care implement 100 to brush a user's teeth with the tooth cleaning elements 115, the capillary member 220 (or the flow barrier 130/apertured film 133) will contact a user's oral tissue surfaces and tongue and the first fluid 103 contained within the capillary member 220 will be delivered onto the user's oral tissue surfaces and tongue due to such contact.

Referring to FIGS. 8 and 8A concurrently, operation of the personal care implement 100 to dispense the first fluid 103 from the capillary member 220 through the opening 126 will be described. FIG. 8 illustrates the personal care implement 100 in a static, non-use state such that the capillary member 220 and the flow barrier 230 are in a non-compressed state. Specifically, there is no pressure being applied to the portion of the second surface 231 of the flow barrier 230 that is exposed through the opening 126. In this state, the first fluid 103 contained within the capillary member 220 remains within the capillary member 220 and it does not pass through the apertures 236 of the flow barrier 230.

FIG. 8A illustrates the personal care implement 100 in a use state such that the capillary member 220 and the flow barrier 230 are in a compressed state. Specifically, a force F is being applied onto the flow barrier 230 and the capillary member 220 to compress them as illustrated. This can occur during normal use of the personal care implement 100 (i.e., such as during toothbrushing as the user's cheek contacts the portion of the flow barrier 230 and capillary member 220 that protrudes from the rear surface 123 of the head 120). The flow barrier 230 is configured to allow flow of the first fluid 103 from the capillary member 220 through the flow barrier 230 (specifically through the apertures 236 thereof) for application to a biological or other surface when the barrier film 230 (and possibly also the capillary member 220) is in the compressed state. Thus, as the barrier film 230 is compressed, it presses against the front surface 221 of the capillary member 220 and forces the first fluid 103 to be dispensed from the capillary member 220 and to pass into and through the apertures 236 in the barrier film 230 for application to a desired biological surface (i.e., the oral cavity). As can be seen, in some embodiments the protuberances 238 of the flow barrier 230/apertured film 233 extend outwardly or protrude from the rear surface 123 of the head 120. Thus, these protuberances 238 may serve an additional function as a tongue or soft tissue cleanser.

Figure 9A:
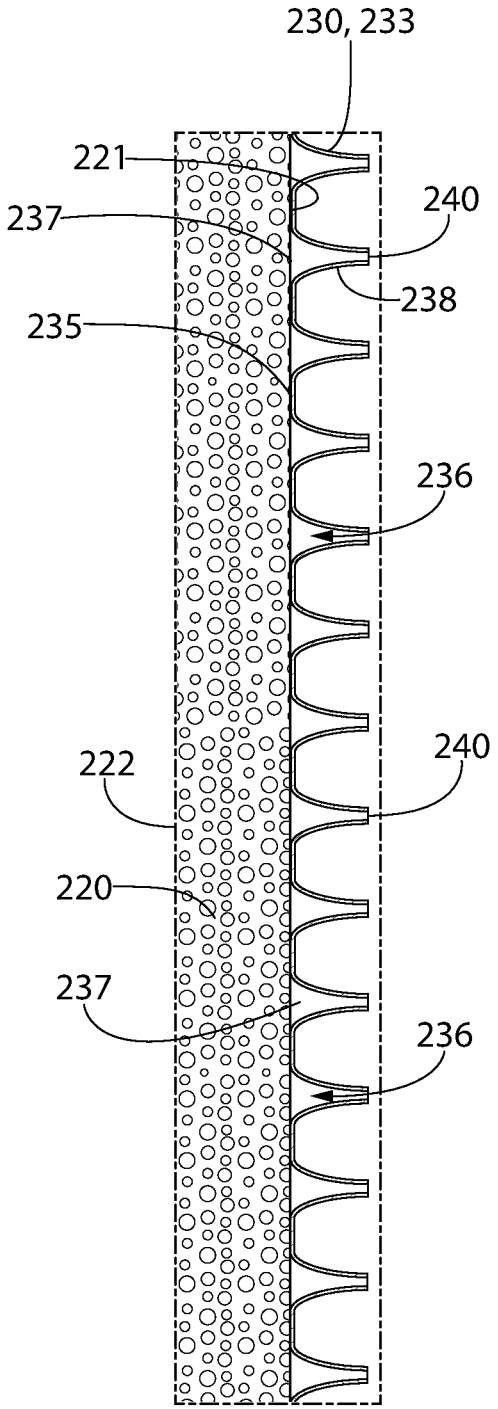
FIGS. 9A and 9B are alternative close-up views of area IXA-IXB of FIG. 8.
Figure 9B:
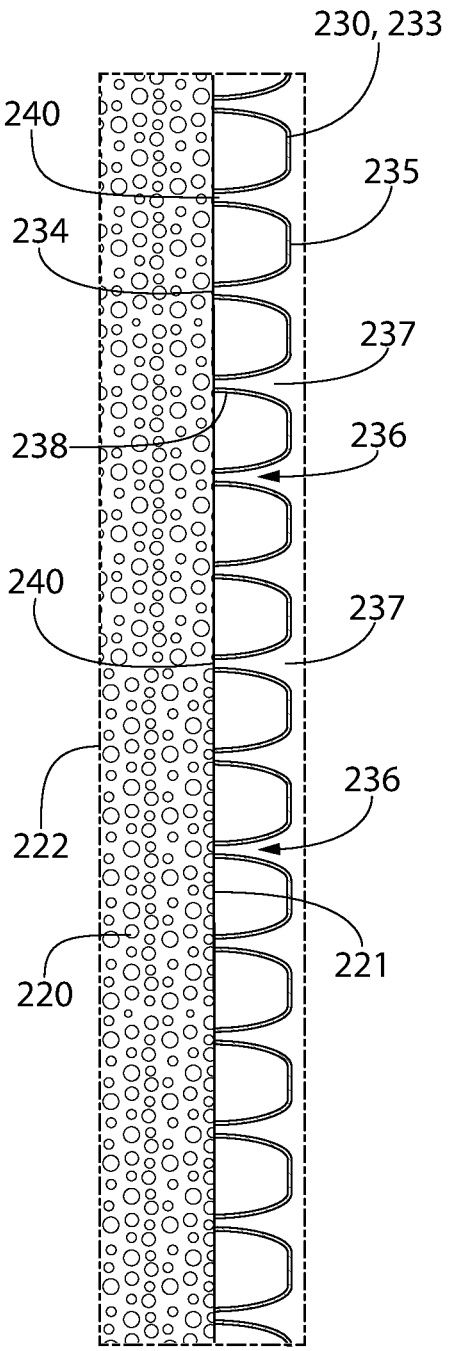

FIGS. 9A and 9B illustrate close-up views of portions of the capillary member 220 with the flow barrier 230 thereon in accordance with alternative embodiments. In FIG. 9A, the first surface 235 of the flow barrier 230 or apertured film 233 is adjacent to the front surface 221 of the capillary member 220 and the second surface 234 of the flow barrier 230 or apertured film 233 is exposed. Thus, in this embodiment the relatively larger first openings 237 of the flow barrier 230/apertured film 233 are adjacent to the capillary member 220 and the relatively smaller second openings 240 of the flow barrier 230/apertured film 233 are exposed at the outer surface of the implement. In this orientation, the first fluid 103 is dispensed from the capillary member 220 through the apertures 236 in the flow barrier 230 when the flow barrier 230 is compressed while a second fluid (i.e., water, saliva, toothpaste slurry, or any other fluid) that is in contact with the second surface 234 of the flow barrier 220/apertured film 233 is prohibited from flowing through the flow barrier in a static state under ambient conditions.

However, the invention is not limited to the orientation of the flow barrier 230 illustrated in FIG. 9A. FIG. 9B is identical to FIG. 9A except the flow barrier 230 has been flipped over so that the second surface 234 of the flow barrier 230 or apertured film 233 is adjacent to the front surface 221 of the capillary member 220 and the first surface 235 of the flow barrier 230 or apertured film 233 is exposed. Thus, in this embodiment the relatively smaller second openings 240 of the flow barrier 230/apertured film 233 are adjacent to the capillary member 220 and the relatively larger first openings 237 of the flow barrier 230/apertured film 233 are exposed at the outer surface of the implement. In this orientation, the same function is achieved in that the first fluid 103 can be dispensed from the capillary member 220 through the apertures 236 when the flow barrier 230 is compressed while a second fluid (i.e., water, saliva, toothpaste slurry, or any other fluid) that is in contact with the first surface 235 of the flow barrier 230 is prohibited from flowing through the flow barrier 230 in a static state under ambient conditions. Although different amounts of the first fluid 103 may pass through the flow barrier 230 depending upon which surface of the flow barrier 230 faces the capillary member 220, it remains that some of it will flow out when the barrier film 230 is compressed while the second fluid will not flow through the barrier film 230 in a static state under ambient conditions.

In certain embodiments, at ambient conditions, the first fluid 103 has a first viscosity and a first surface tension and the second fluid has a second viscosity and a second surface tension. Furthermore, in certain embodiments either the first viscosity is different from the second viscosity, the first surface tension is different than the second surface tension, or both. In one embodiment the first viscosity of the first fluid 103 may be greater than the second viscosity of the second fluid. In another embodiment the first surface tension of the first fluid 103 may be less than the second surface tension of the second fluid. In still another embodiment the first viscosity may be greater than the second viscosity and the first surface tension may be less than the second surface tension. These specific properties of viscosity and surface tension of the first and second fluids aids in allowing the first fluid 103 to flow through the flow barrier 230 in a compressed state and prohibiting the second fluid from flowing through the flow barrier 230 in a static state under ambient conditions.

As used herein, ambient conditions refer to a set of parameters that include temperature and pressure being under standard or normal conditions. Ambient conditions may in certain embodiments be the standard ambient temperature of approximately 25° C. and the standard ambient pressure which is an absolute pressure of approximately 100 kPa (1 bar).

Figure 10:
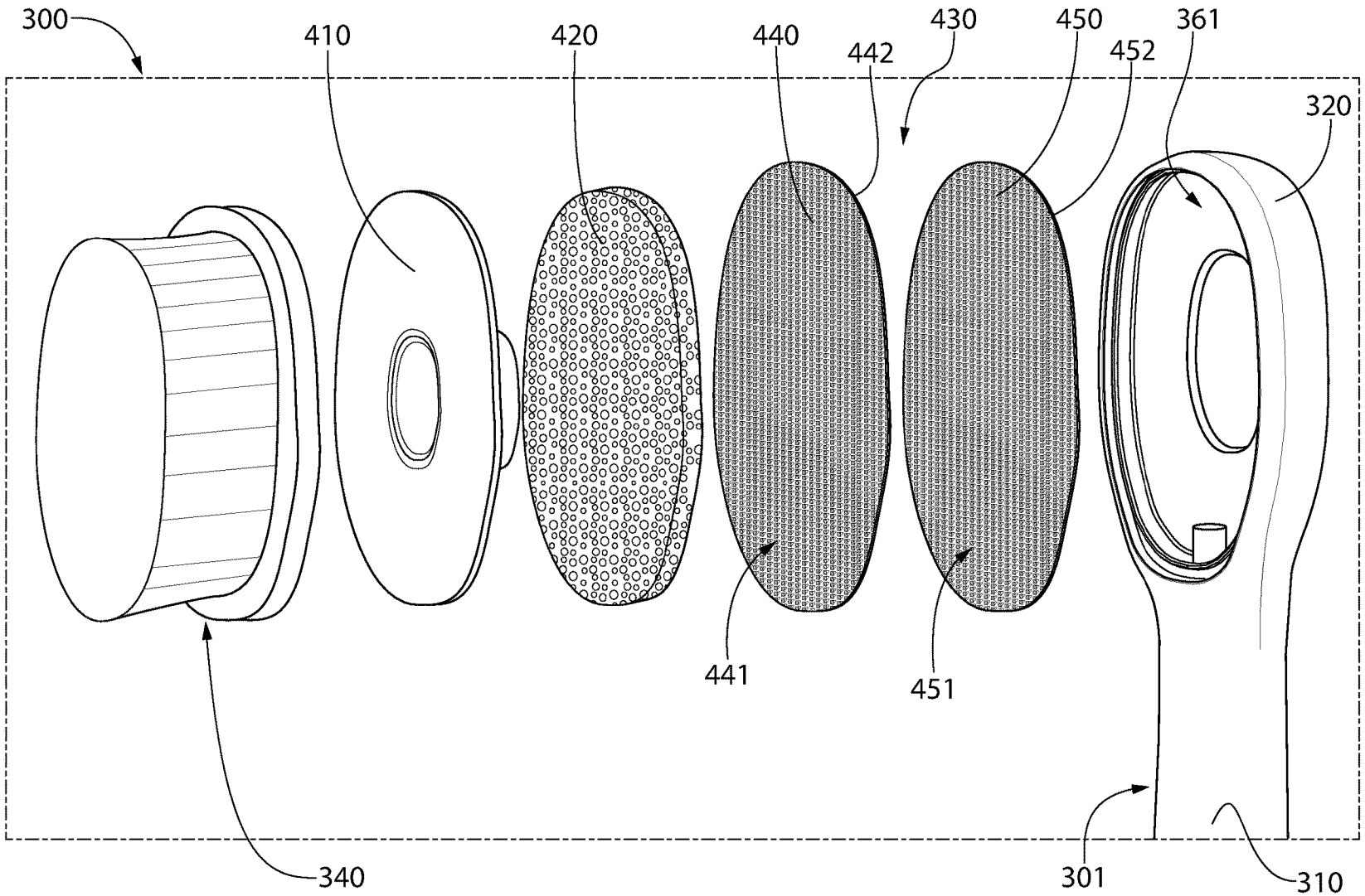
FIG. 10 is an exploded close-up view similar to FIG. 3 with the addition of a second apertured film.
Figure 11:
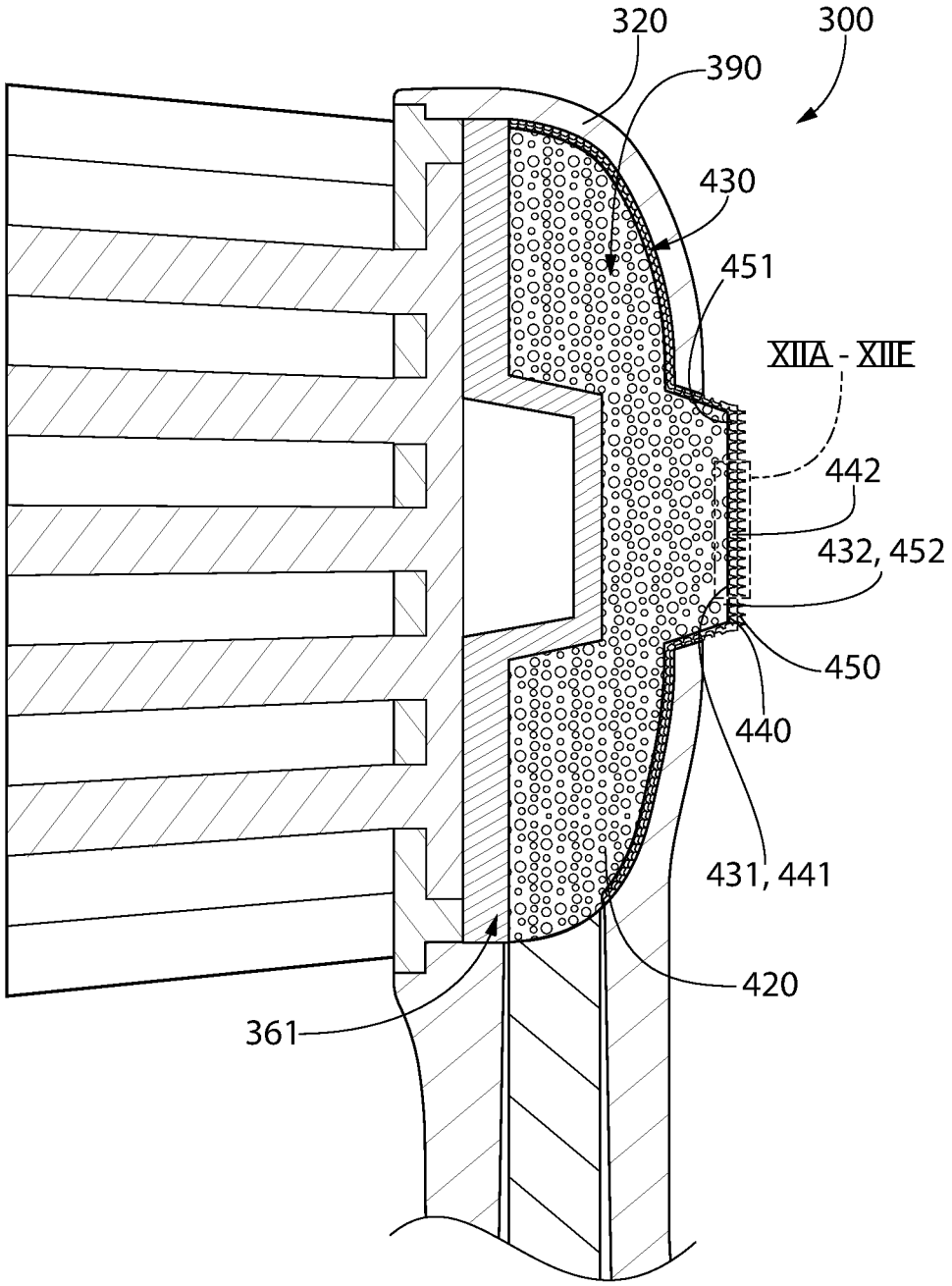
FIG. 11 is a cross-sectional view similar to FIG. 8 with the addition of a second apertured film.

Referring to FIGS. 10 and 11, an alternative embodiment of a personal care implement 300 is illustrated. The personal care implement 300 comprises a body 301 comprising a handle 310 and a head 320. A cleaning element assembly 340 is illustrated similar to the cleaning element assembly 140 described above. The details of the handle 310 with regard to its internal and external structure and the distinct components therein are identical to the details of the handle 110 described above and thus they will not be repeated herein in the interest of brevity. The personal care implement 300 comprises a divider member 410, a capillary member 420 and a flow barrier 430 that are disposed within a basin cavity 361 of a head 320 much the same as described above with regard to the personal care implement 100. The capillary member 420 forms a portion of a supply 390 as described above with regard to the personal care implement 100. Thus, the personal care implement 300 is identical to the oral care implement 100 except that the flow barrier 430 comprises a first apertured film 440 and a second apertured film 450. Of course, mechanisms other than the first and second apertured films 440, 450 may be used to achieve the same functionality as has been described herein above.

The flow barrier 430 comprises a first surface 431 that is adjacent to the capillary member 420 and an opposite second surface 432. The first and second apertured films 440, 450 are positioned adjacent to one another within the basin cavity 361. Specifically, the first apertured film 440 comprises a first surface 441 and an opposite second surface 442. The second apertured film 450 comprises a first surface 451 and an opposite second surface 452. The first surface 441 of the first apertured film 440 forms the first surface 431 of the flow barrier 430. The second surface 452 of the second apertured film 450 forms the second surface 432 of the flow barrier 430. The second surface 442 of the first apertured film 440 faces and is adjacent to the first surface 451 of the second apertured film 450. Thus, the second apertured film 450 is positioned or stacked atop the first apertured film 440 to form a laminate structure that collectively forms the flow barrier 430. In this embodiment, the first and second apertured films 440, 450 collectively operate to allow flow of the first fluid 103 through the capillary member 420 when the flow barrier 430 is compressed while prohibiting flow of a second fluid that is in contact with the second surface 432 of the flow barrier 430 through the flow barrier 430 in a static state under ambient conditions.

The differences in viscosity and surface tension of the first and second fluids as discussed above are equally applicable to this embodiment. Furthermore, the allowance of flow of the first fluid 103 in one direction under certain conditions (with the flow barrier 430 in the compressed state) and the prohibition of flow of the second fluid in the opposite direction under certain conditions (with the flow barrier in a static state under ambient conditions) described above is applicable to this embodiment. However, in this embodiment some of the fluid (first fluid and/or second fluid) may become trapped between the two apertured films 440, 450 thereby further increasing the prohibition of flow of the second fluid through the flow barrier 430 and potentially also decreasing the amount of the first fluid 103 that flows through the flow barrier 430 during a given compression of the flow barrier 430.

Figure 12A:
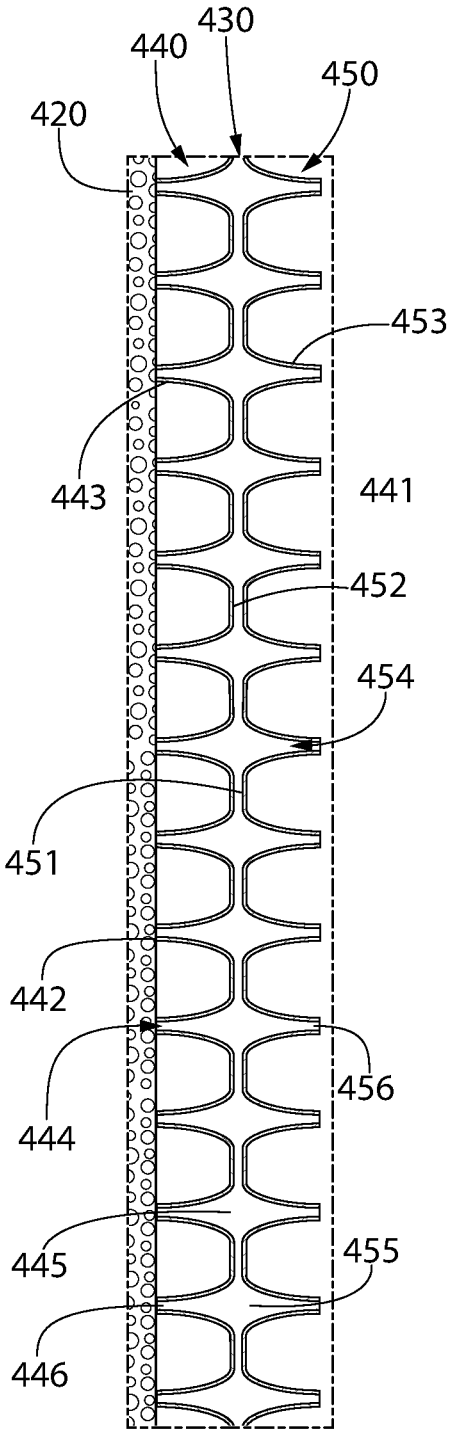
FIGS. 12A-12E are alternative close-up views of area XIIA-XIIE of FIG. 11.

FIGS. 12A-12D illustrate various orientations that the first and second apertured films 440, 450 may be placed in relative to one another. Referring first to FIG. 12A, the first apertured film 440 has a plurality of protuberances 443 extending from the second surface 442 and a plurality apertures 444 extending through the first apertured film 440. More specifically, as discussed above one of the apertures 444 extends through each of the protuberances 443, although the protuberances 443 may be omitted in other embodiments. The apertures 444 are tapered from the first surface 441 to the second surface 442. Thus, the apertures 444 have a relatively larger opening 445 at the first surface 441 and a relatively smaller opening 446 at the second surface 442. Similarly, the second apertured film 450 has a plurality of protuberances 453 extending from the second surface 452 and a plurality apertures 454 extending through the second apertured film 450. More specifically, as discussed above one of the apertures 454 extends through each of the protuberances 453, although the protuberances 453 may be omitted in other embodiments. The apertures 454 are tapered from the first surface 451 to the second surface 452. Thus, the apertures 454 have a relatively larger opening 455 at the first surface 451 and a relatively smaller opening 456 at the second surface 452.

In FIG. 12A, the first apertured film 440 is positioned with the second surface 442 of the first apertured film 440 adjacent to the capillary member 420. Thus, the relatively smaller openings 446 of the first apertured film 440 are adjacent to the capillary member 420. The second apertured film 450 is positioned with the first surface 451 of the second apertured film 450 adjacent to the first surface 441 of the first apertured film 440. Thus, the relatively large openings 455 of the second apertured film 450 are adjacent to the larger openings 445 of the first apertured film 450. In this embodiment, the protuberances 443, 453 of the first and second aperture films are aligned with one another. However, this is not required in all embodiments and they can be offset in alternative embodiments.

Figure 12B:
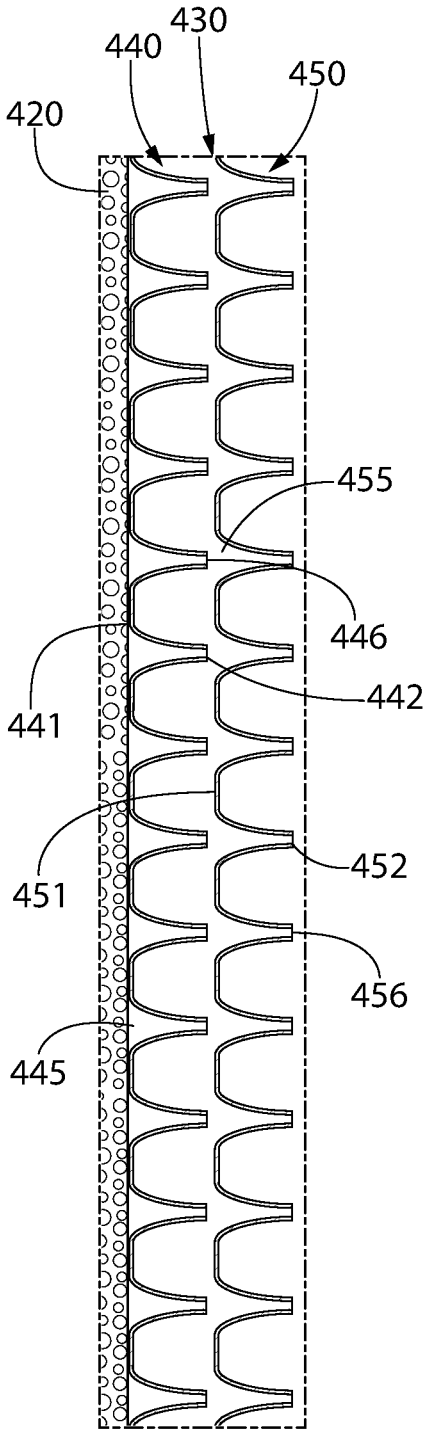

In FIG. 12B, the first apertured film 440 has been flipped so that the first surface 441 of the first apertured film 440 is adjacent to the capillary member 420. Thus, the relatively larger openings 445 of the first apertured film 440 are adjacent to the capillary member 420. The second apertured film 450 is in the same orientation as with FIG. 12A with the first surface 451 facing down. However, in this embodiment because the first apertured film 440 has been flipped, the relatively larger openings 455 of the second apertured film 450 are adjacent to and facing the relatively smaller openings 446 of the first apertured film 440. In this embodiment, the protuberances 443, 453 of the first and second aperture films are aligned with one another such that the protuberance 443 in the first apertured film 440 nests within the protuberance 453 of the second apertured film 450. However, this is not required in all embodiments and the protuberances 443, 453 of the first and second apertured films 440, 450 can be offset in alternative embodiments.

Figure 12C:
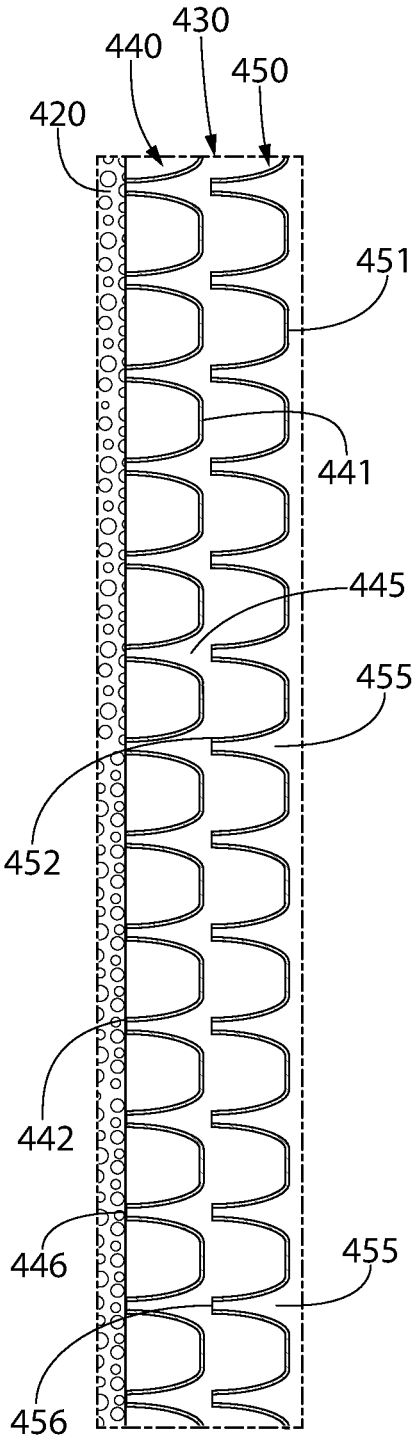

FIG. 12C is similar to FIG. 12A except the second apertured film 450 has been flipped. Thus, in this embodiment, the first apertured film 440 is positioned with the second surface 442 of the first apertured film 440 adjacent to the capillary member 420. Thus, the relatively smaller openings 446 of the first apertured film 440 are adjacent to the capillary member 420. The second apertured film 450 is positioned with the second surface 452 of the second apertured film 450 adjacent to the first surface 441 of the first apertured film 440. Thus, the relatively smaller openings 456 of the second apertured film 450 are adjacent to the relatively larger openings 445 of the first apertured film 440. In this embodiment, the protuberances 443, 453 of the first and second aperture films are aligned with one another such that the protuberance 453 in the second apertured film 450 nests within the protuberance 443 of the first apertured film 440. However, this is not required in all embodiments and the protuberances 443, 453 of the first and second apertured films 440, 450 can be offset in alternative embodiments.

Figure 12D:
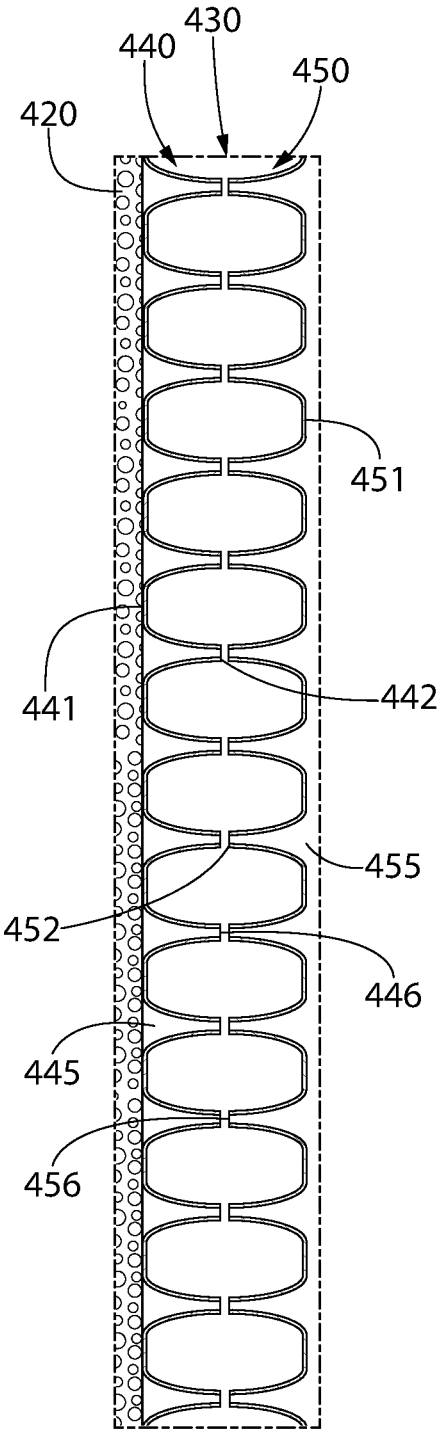

FIG. 12D is similar to FIG. 12C except that the first apertured film 440 has been flipped. Thus, in this embodiment, the first apertured film 440 is positioned with the first surface 441 of the first apertured film 440 adjacent to the capillary member 420. Thus, the relatively larger openings 445 of the first apertured film 440 are adjacent to the capillary member 420. The second apertured film 450 is positioned with the second surface 452 of the second apertured film 450 adjacent to the second surface 442 of the first apertured film 440. Thus, the relatively smaller openings 456 of the second apertured film 450 are adjacent to the relatively smaller openings 446 of the first apertured film 440. Again in this embodiment the protuberances 443, 453 can be aligned or offset in varying amounts.

FIGS. 12A-12D are provided to illustrate that the personal care implement 300 functions properly with a two-film (i.e., laminate, multi-layer, etc.) flow barrier 430 regardless of which of the surfaces of the first apertured film 440 is facing the capillary member 420 and which of the first and second surfaces 441, 442, 451, 452 of the first and second apertured films 440, 450 are facing one another. In all of the embodiments illustrated in FIGS. 12A-12D, the first fluid 103 that is on/in the capillary member 420 is permitted to flow through the flow barrier 430 for application to a biological surface in a compressed state while the flow barrier 430 prohibits a second fluid (water, saliva, toothpaste slurry, or the like as described herein above) that is in contact with the second surface 432 of the flow barrier 430 from flowing through the flow barrier 430 in a static state under ambient conditions.

Figure 12E:
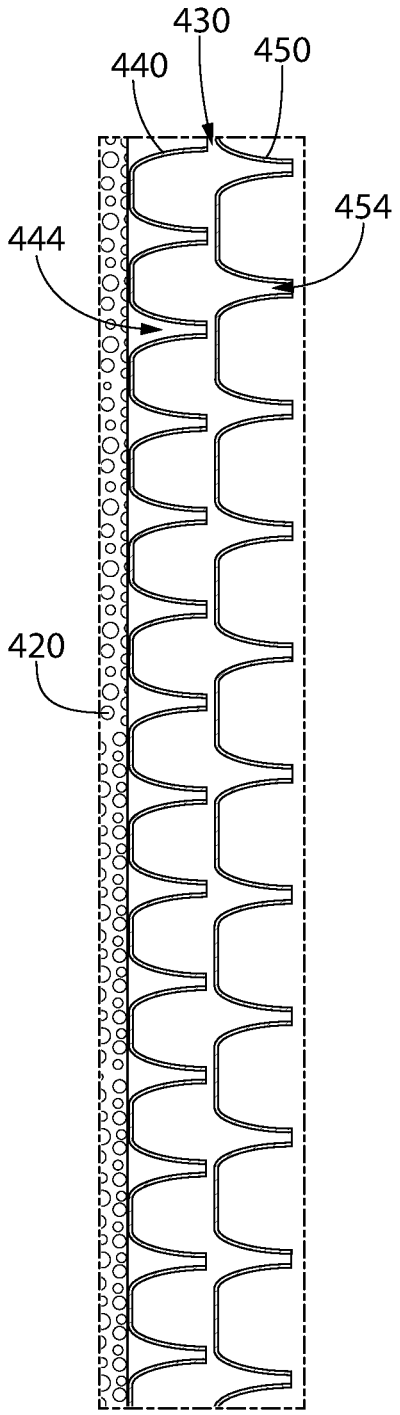

FIG. 12E illustrates yet another embodiment where the flow barrier 430 comprises the first and the second apertured films 440, 450. However, in this embodiment the first and second apertured films 440, 450 have a different density of the apertures 444, 454. Specifically, in the exemplified embodiment, the first apertured film 440 has a greater density of the apertures 444 than the second apertured film 450 has of the apertures 454. Thus, as a non-limiting example, the first apertured film 440 may have forty apertures 444 per linear inch whereas the second apertured film 450 may have twenty apertures 454 per linear inch. Due to the difference in density of the apertures 444, 454, the apertures 444 of the first apertured film 440 are not all aligned with one of the apertures 454 of the second apertured film 450. Rather, some of the apertures 444 of the first apertured film 444 are aligned with one of the apertures 454 of the second apertured film 450 while others of the apertures 444 of the first apertured film 444 are not aligned with one of the apertures 454 of the second apertured film 450. Of course, the first and second apertured films 440, 450 could have their locations swapped. Furthermore, this density variation remains possible with any of the variations in orientation of the first and second apertured films 440, 450 as shown in FIGS. 12A-12D.

Furthermore, more than two of the apertured films may be used as the flow barrier 430 in still other embodiments. Thus, there may be three apertured films, four apertured films, etc. to achieve the controlled flow of the first fluid in one direction and prevention of flow of a second fluid in the opposite direction. Of course, there must be a balance achieved because the more apertured films that are used in the flow barrier 430 the less amount of the first fluid that will flow out through the flow barrier 430. Thus, in certain embodiments two apertured films may be an optimal number of apertured films to use as the flow barrier 430, but the invention is not to be limited in this regard in all embodiments.

Figure 13:
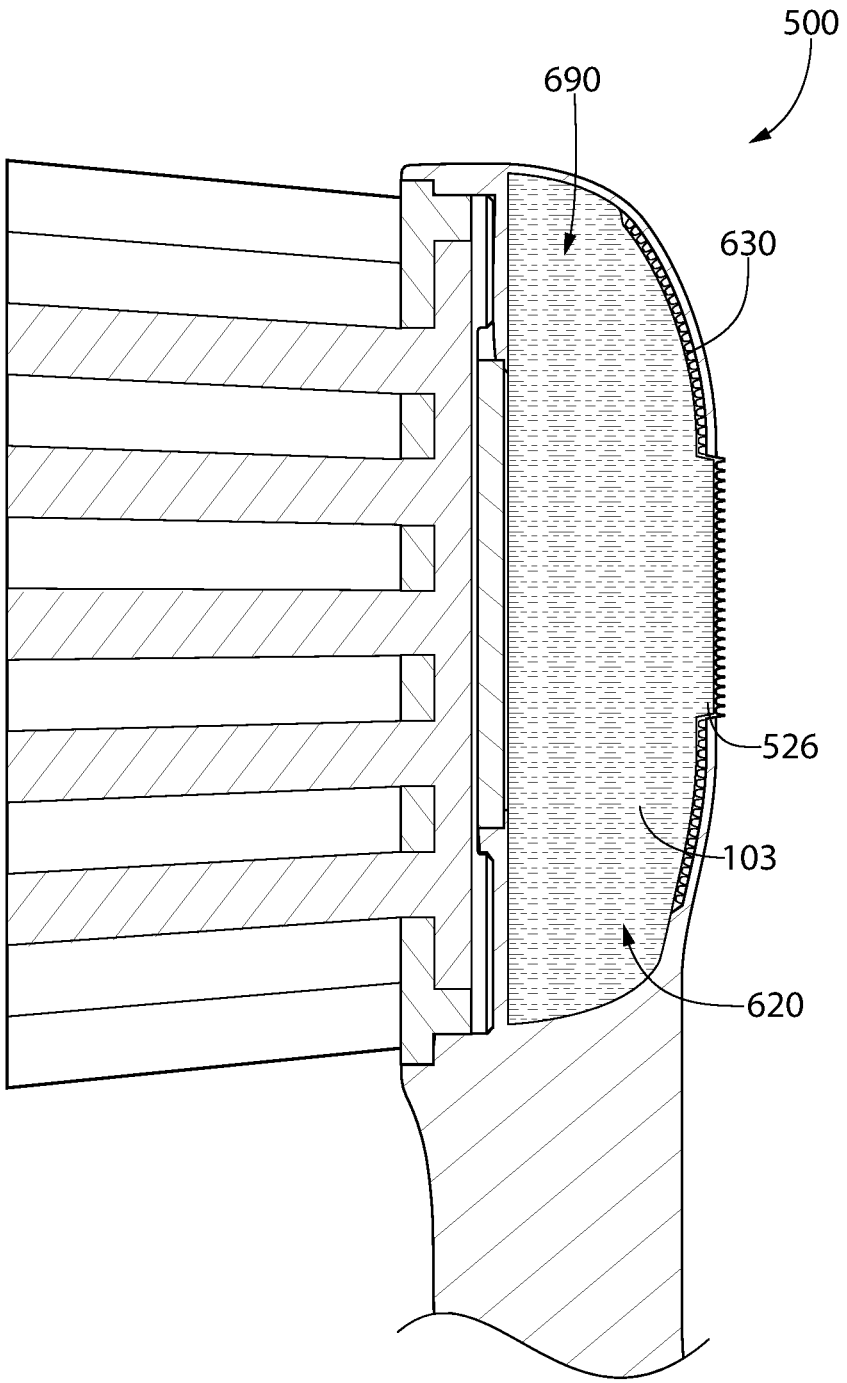
FIG. 13 is a cross-sectional view similar to FIG. 8 in accordance with an alternative embodiment of the present invention.

Referring now to FIG. 13, another alternative embodiment of an oral care implement 500 is illustrated. FIG. 13 illustrates only the head 520 of the oral care implement 500. In this embodiment, there is no reservoir in the handle and there is no capillary member. Instead, the supply 690 comprises a reservoir or cavity 620 within the head 520 that retains the first fluid 103 therein. Thus, there is no porous pad or other capillary member loaded with the first fluid 103, but instead the first fluid 103 is merely held or retained within the reservoir or cavity 620 in the head. The flow barrier 630 closes the opening 526 in the head 520 to retain the first fluid 103 within the reservoir or cavity 620. However, this oral care implement 500 operates in a similar manner to those previously described. Specifically, the flow barrier 630 is the same as that which was described above and it is configured to allow flow of the first fluid 103 from the reservoir or cavity 620 through the flow barrier 630 for application to a biological surface in a compressed state. Furthermore, the flow barrier 630 is configured to prohibit flow of a second fluid (such as any of the second fluids identified above) that is in contact with the exposed outer surface of the flow barrier 630 through the flow barrier 630 in a static state under ambient conditions.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A personal care implement comprising:

a body containing a supply of a first fluid;

a flow barrier having a first surface adjacent the supply and a second surface opposite the first surface, the flow barrier configured to: (1) allow flow of the first fluid from the supply through the flow barrier for application to a biological surface in a compressed state; and (2) prohibit flow of a second fluid that is in contact with the second surface of the flow barrier through the flow barrier in a static state under ambient conditions; and wherein, at ambient conditions, the first fluid has a first viscosity and a first surface tension and the second fluid has a second viscosity and a second surface tension, the first viscosity being greater than the second viscosity.

2. The personal care implement according to claim 1 wherein the first surface tension is different than the second surface tension.

3. The personal care implement according to claim 2 wherein the first surface tension is less than the second surface tension.

4. The personal care implement according to claim 1 wherein the supply of the first fluid comprises a capillary member loaded with the first fluid.

5. The personal care implement according to claim 4 wherein the first surface of the flow barrier is adjacent the capillary member.

6. The personal care implement according to claim 4 wherein the flow barrier is flexible and the capillary member is compressible.

7. The personal care implement according to claim 4 wherein the capillary member is formed of a porous foam.

8. The personal care implement according to claim 4 wherein the supply further comprises a reservoir in the body containing a store of the first fluid and a capillary tube, the capillary tube configured to deliver the first fluid from the store to the capillary member via a wicking action.

9. The personal care implement according to claim 4 wherein the capillary member protrudes from the body.

10. The personal care implement according to claim 1 wherein the flow barrier comprises a first apertured film comprising a first surface, a second surface, and a plurality of first apertures.

11. The personal care implement according to claim 10 wherein each of the first apertures extend from a first opening in the first surface of the first apertured film to a second opening in the second surface of first apertured film, and wherein the first opening has a transverse area that is greater than a transverse area of the second opening.

12. The personal care implement according to claim 10 wherein the flow barrier comprises a second apertured film comprising a first surface, a second surface, and a plurality of second apertures; and wherein the second apertured film is positioned atop the first apertured film to form a laminate structure whereby the first surface of the first apertured film forms the first surface of the flow barrier and the second surface of the second apertured film forms the second surface of the flow barrier.

13. A personal care implement comprising:

a body containing a supply of a first fluid; and a first apertured film adjacent the supply of the first fluid for dispensing the first fluid to a biological surface, the first apertured film comprising:

a first surface;

a second surface opposite the first surface; and a plurality of first apertures, each of the first apertures extending from a first opening in the first surface of the first apertured film to a second opening in the second surface of the first apertured film, and wherein the first opening has a transverse area that is greater than a transverse area of the second opening.

14. The personal care implement according to claim 13 wherein each of the first apertures tapers from the first opening to the second opening.

15. The personal care implement according to claim 13 wherein the second surface of the first apertured film comprises a plurality of first protuberances; and wherein the first apertures extend through the first protuberances.

16. The personal care implement according to claim 13 wherein the first surface of the first apertured film is adjacent to the supply of the first wherein the second openings of the first apertures are sized to prohibit flow of water that is in contact with the second surface of the first apertured film through the first apertures in a static state under ambient conditions; and wherein the first openings of the first apertures are sized to allow flow of the first fluid from the supply through the first apertures when in a compressed state.

17. The personal care implement according to claim 13 further comprising:

a second apertured film stacked atop the first apertured film to form a laminate structure, the second apertured film comprising:

a first surface adjacent the second surface of the first aperture film;

a second surface opposite the first surface of the second apertured film; and a plurality of second apertures, each of the second apertures extending from a first opening in the first surface of the second apertured film to a second opening in the second surface of second apertured film, and wherein the first opening has a transverse area that is greater than a transverse area of the second opening.

18. The personal care implement according to claim 13 wherein the supply of the first fluid comprises a capillary member loaded with the first fluid.

19. The personal care implement according to claim 18 wherein the supply further comprises a reservoir in the body containing a store of the first fluid and a capillary tube, the capillary tube configured to deliver the first fluid from the store to the capillary member via a wicking action.

20. The personal care implement according to claim 18 wherein at least a portion of the capillary member extends through an opening in the body; and wherein the first apertured film covers the opening.

21. A personal care implement comprising:

a body containing a supply of a first fluid, the supply of the first fluid comprising a capillary member loaded with the first fluid;

a flow barrier having a first surface adjacent the supply and a second surface opposite the first surface, the flow barrier configured to: (1) allow flow of the first fluid from the supply through the flow barrier for application to a biological surface in a compressed state; and (2) prohibit flow of a second fluid that is in contact with the second surface of the flow barrier through the flow barrier in a static state under ambient conditions; and wherein, at ambient conditions, the first fluid has a first viscosity and a first surface tension and the second fluid has a second viscosity and a second surface tension, at least one of the first viscosity being different than the second viscosity or the first surface tension being different than the second surface tension.

22. The personal care implement according to claim 21 wherein the first surface of the flow barrier is adjacent the capillary member.

* * * * *